US012264579B2

(12) United States Patent
Sperle et al.

(10) Patent No.: US 12,264,579 B2
(45) Date of Patent: Apr. 1, 2025

(54) TRACER RELEASE SYSTEM AND METHOD OF USE

(71) Applicant: RESMAN AS, Ranheim (NO)

(72) Inventors: Thomas Sperle, Ranheim (NO); Øystein Mølstre, Ranheim (NO)

(73) Assignee: Resman AS, Ranheim (NO)

( * ) Notice: Subject to any disclaimer, the term of this patent is extended or adjusted under 35 U.S.C. 154(b) by 408 days.

(21) Appl. No.: 17/613,705

(22) PCT Filed: May 23, 2020

(86) PCT No.: PCT/EP2020/064347

§ 371 (c)(1),
(2) Date: Nov. 23, 2021

(87) PCT Pub. No.: WO2020/239647

PCT Pub. Date: Dec. 3, 2020

(65) Prior Publication Data

US 2022/0228478 A1 Jul. 21, 2022

(30) Foreign Application Priority Data

May 24, 2019 (GB) ..... 1907368

(51) Int. Cl.

| | |
|---|---|
| ***E21B 47/11*** | (2012.01) |
| ***E21B 34/08*** | (2006.01) |
| ***E21B 43/14*** | (2006.01) |

(52) U.S. Cl.

CPC ..... *E21B 47/11* (2020.05); *E21B 34/08* (2013.01); *E21B 43/14* (2013.01); *E21B 2200/02* (2020.05); *E21B 2200/06* (2020.05)

(58) Field of Classification Search

CPC ..... E21B 47/11; E21B 34/08; E21B 2200/02; E21B 2200/06; E21B 43/14

See application file for complete search history.

(56) References Cited

U.S. PATENT DOCUMENTS

| | | | | |
|---|---|---|---|---|
| 2003/0056952 | A1 | 3/2003 | Stegemeier et al. | |
| 2003/0131991 | A1 | 7/2003 | Hartog et al. | |
| 2004/0084186 | A1* | 5/2004 | Allison | E21B 41/02 166/305.1 |
| 2020/0263535 | A1* | 8/2020 | Roessler | E21B 47/09 |

FOREIGN PATENT DOCUMENTS

| | | | |
|---|---|---|---|
| EP | 1416118 | A1 | 5/2004 |
| EP | 3039225 | B1 | 1/2018 |
| WO | WO 2001/65053 | A1 | 9/2001 |
| WO | WO 2001/92685 | A1 | 12/2001 |
| WO | WO 2017100615 | A1 | 6/2017 |
| WO | WO 2018143814 | A1 | 8/2018 |

OTHER PUBLICATIONS

International Search Report dated Jan. 15, 2021 for PCT/EP2020/064347.

* cited by examiner

*Primary Examiner* — Dany E Akakpo
(74) *Attorney, Agent, or Firm* — FisherBroyles, LLP

(57) ABSTRACT

The invention provides a tracer release system (100) and method of use. The tracer release comprises at least one tracer chamber for connection to a production tubing (12). The at least one tracer chamber comprising at least one inlet (118), at least one outlet (120), a fluid volume (122) and a tracer material (124) located in the fluid volume. The tracer chamber also comprises a valve (126) configured to selectively open and/or close the at least one outlet.

30 Claims, 24 Drawing Sheets

TRACER RELEASE SYSTEM AND METHOD OF USE

This application is the U.S. National Stage of International Application No. PCT/EP2020/064347, which was filed on May 23, 2020. This application also claims the benefit of the filing date of GB patent application No. GB1907368.3, which was filed on May 24, 2019. The contents of both of those applications are hereby incorporated by reference.

The present invention relates to an apparatus and method for releasing tracer into a production well for flow measurement and monitoring wellbore inflow profiles during production. Aspects of the invention include a tracer release apparatus to store and selectively release the tracer and a method of use.

BACKGROUND TO THE INVENTION

Downhole tracers installed in producer wells have been proven for estimating which fluids flow in which parts of the well, and at which flow rates. Traditionally, different tracers have been placed in different influx zones to a production completion installed in a well.

Methods of monitoring fluid rate in a well are known, including quantification based on transient flow where distinct tracers are arranged at different influx zones in a well. The well is shut-in for a period of time to allow a high concentration of tracers to build up at the individual influx zones, and then the well is re-started to carry the tracers to surface. Sampling and analysis of the concentration of the different tracers is used to provide qualitative and quantitative production data.

EP2633152 discloses a method of estimating influx profile for well fluids (oil, gas, or water) to petroleum well with influx locations to a production flow. The method comprises arranging tracer sources with tracer materials in levels of the well and inducing a transient in the production rate of the entire production flow by shutting in the well. The method comprises collecting and analysing samples and based on said concentrations and their sampling sequence and the well geometry, calculating influx volumes from flow models.

However, these methods limit the number of opportunities for obtaining tracer data, as shutting in the well is a complex and highly expensive operation requiring significant project planning and resulting in loss of revenue due to interruption to production.

Regularly restarting a well after a shut in may present risks to the well infrastructure. Forcing the fluid column in the well to start moving after a long period of rest may lead to very complex pressure, flow rate and temperature changes in the infrastructure. The sudden changes can pose a real threat to equipment, in the worst case, permanently impairing production or even requiring recompleting or sidetracking the well.

It may also be problematic lifting a column of heavy fluids when restarting a well after a shut in. In some cases restarting a well may not be possible.

Another problem of known downhole tracer techniques is that due to the downhole conditions pressure variations can exist in the well which can affect the flow of the tracers downhole. This can result in situations where tracers travel upstream or flow into other zones in the formation which is known cross-flow. Cross flow presents uncertainties and can affect the accuracy of flow rate analysis.

SUMMARY OF THE INVENTION

It is amongst the aims and objects of the invention to provide a tracer release apparatus for selectively releasing tracer into the production flow to allow flow measurement and wellbore inflow profiles to be calculated and monitored.

It is another object of the present invention to provide a tracer release apparatus which is capable of building up a high or increased concentration of tracer molecules and selectively releasing the tracer molecules without requiring the well to be shut in.

It is a further object of an aspect of the invention to provide a tracer release apparatus which is capable of releasing a high concentration of tracer molecules as a tracer cloud which can be detected in the production at surface but also controls the exposure of the tracer source to production fluid to extend the lifespan of the tracer downhole.

Further aims and objects of the invention will become apparent from reading the following description.

According to a first aspect of the invention, there is provided a tracer release system for a producing petroleum well comprising;

- at least one tracer release apparatus for connection to a production tubing, the at least one tracer release apparatus comprising;
- at least one outlet;
- at least one tracer chamber in fluid communication with the at least one outlet;
- a tracer material located in the at least one tracer chamber; and
- at least one valve configured to selectively control the flow of fluid through the at least one outlet.

By providing a tracer release apparatus with at least one valve configured to selectively control the flow of fluid through the at least one outlet may allow the apparatus to be shut in to increase the concentration of tracer molecules in a fluid volume of the apparatus. The subsequent opening of the valve to release the increased concentration of tracer may create a tracer transient. The increased concentration of tracer molecules propagates downstream with production flow as a tracer cloud, slug or shot which may be detectable downstream of the apparatus and/or topside as tracer response signal or spike at the downstream detection point.

The tracer transients are driven by the velocity field in the well. The topside arrivals of the onset of the different tracers, or the full transient of the different tracers, can be used to estimate the downhole velocity field. From the velocity field the inflow profile may be calculated.

The at least one tracer release apparatus may comprise at least one inlet. The at least one inlet may be in fluid communication with the at least one tracer chamber. The at least one valve may be configured to selectively control the flow of fluid through the at least one inlet.

The at least one valve may be configured to shut in the tracer release apparatus during production in the well. The at least one valve may be configured to selectively open and close the at least one inlet and/or outlet to control the flow of fluid through the at least one inlet and/or outlet.

The at least one valve may be configured to selectively open and close the at least one inlet between a fully open position, a fully closed position, or to an intermediate position between the fully open and fully closed position. The at least one valve may be configured to selectively open and close the at least one outlet between a fully open position, a fully closed position, or to an intermediate position between the fully open and fully closed position. The at least one valve may be operated to control flow and vary the area of openings for flow through the at least one inlet and/or through the at least one outlet.

The tracer material may be configured to selectively release tracer molecules from the tracer material into a well fluid in the tracer chamber on contact with a particular well fluid. Preferably the tracer material is designed to release tracer molecules into the tracer chamber when the tracer material is exposed to a target fluid i.e. oil, gas or water. The tracer material may be a solid, liquid or gas.

Preferably the least one tracer chamber has a flow passage with a fluid volume. The fluid volume may be a fixed fluid volume.

The dimensions of the fluid volume may be designed to produce a known volume of fluid with increased concentration of tracer molecules when the fluid volume is shut in. The release of increase concentration of tracer molecules into the production flow as a tracer cloud may create a tracer transient which may be detectable as a tracer response spike at the downstream detection point.

The shut in fluid volume may be enriched or saturated with tracer molecules. The fluid volume dimensions may be designed for different tracer types or different target fluid types. Different fluid volume dimensions may be used depending on the detection limit of the tracer. For example, a tracer with a low detection limit may require a higher volume of enriched tracer fluid to be released to allow detection.

The dimensions of the fluid volume may be adjusted or configured depending on the desired operation or lifespan of the tracer release apparatus. For example, a tracer release apparatus designed for a long downhole lifespan may require a smaller fluid volume to restrict the amount of tracer released with each release operation.

The tracer material may be selected from the group comprising chemical, fluorescent, phosphorescent, magnetic, DNA and radioactive compounds. The tracer material may comprise chemical tracers selected from the group comprising perfluorinated hydrocarbons or perfluoroethers. The perfluorinated hydrocarbons may be selected from the group of perfluoro buthane (PB), perfluoro methyl cyclopentane (PMCP), perfluoro methyl cyclohexane (PMCH).

The tracer material may be chemically immobilized within and/or to the tracer chamber. The tracer material may comprise a tracer and a carrier. The carrier may be a matrix material. The matrix material may be a polymeric material.

The tracer may be chemically immobilized within and/or to the carrier. The tracer material may be chemically immobilized by a chemical interaction between the tracer and the carrier. The tracer material may be chemically immobilized in a way that it releases tracer molecules or particles in the presence of a chemical trigger.

By varying the chemical interaction between the tracer and the polymer the release mechanism and the rate of release of tracer molecules from the tracer material may be controlled. Preferably the tracer is released from the tracer carrier with an even release rate.

The carrier may be a selected from poly methyl methacrylates (PMMA), poly methylcrylates, poly ethylenglycols (PEG), poly lactic acid (PLA) or poly glycolic acid (PGA) commercially available polymers or copolymers thereof.

The carrier may be selected from polymers with higher rates of tracer molecules release such as polyethylene and polypropylene. The tracer may be physically dispersed and/or physically encapsulated in the carrier.

The tracer material may release tracer molecules into fluid by dissolution or degradation of the carrier and/or the tracer into the fluid. The carrier may be selected to controllable degrade on contact with a fluid. The carrier may be selected to degrade by hydrolysis of the carrier. The tracer and/or the carrier may be fluid specific such that the tracer molecules will be released from the tracer material as a response to a contact with a target liquid.

The tracers and/or the carrier may be chemically intelligent such that tracer molecules will be released from the tracer material as a response of specific events, e.g. they respond to an oil flow (oil-active) but show no response to a water flow (water-resistant). Another group of chemical compounds can be placed in the same region, which release tracers in water flow (water-active) but show no response to an oil flow (oil-resistant). The tracers and/or the carrier may be chemically intelligent such that tracer molecules will be released from the tracer material as a response the exposure of the tracer material to a well fluid and/or a target well fluid.

The tracer molecules may be detected and its concentration measured by different techniques such as optical detection, optical fibers, spectrophotometric methods, PCR techniques combined with sequential analysis, chromatographic methods, or radioactivity analysis. The invention is not restricted to the above-mentioned techniques.

The tracer molecules may be detected and its concentration measured by sampling production fluid. The sampling may be conducted at the one or more of said sampling times. The sampling may be conducted downhole downstream of the tracer release apparatus or at surface. Samples may be collected for later analysis.

The tracer molecules may be detected by a detection device such a probe. The detection device may facilitate real time monitoring and/or analysis of the tracer in the production fluid.

The tracer material may be disposed in the tracer chamber to allow fluid to contact the tracer material as it passes around the tracer material in the tracer chamber.

The at least one valve may be an electrically actuated valve, a mechanical valve and/or thermodynamic valve. The at least one valve may be a controllable valve. The at least one valve may be configured to selectively open and/or close in response to a well event. The at least one valve may be configured to selectively open and/or close in response to a signal from surface. The at least one valve may be configured to selectively open and/or close in response to a change in temperature, pressure and/or velocity. The at least one valve may be configured to selectively open and/or close in response to at least one electronic signal.

The at least one valve may be configured to selectively open and/or close in response to inducing a transient in the production rate of the production flow. The transient may be a temporary transient in the production rate of the production flow.

The at least one valve may be a differential pressure operated valve. The at least one valve may be configured to selectively open and/or close in response to a pressure differential across the valve.

The at least one valve may be configured to selectively open and/or close in response to changes in fluid pressure in the well. The at least one valve may be configured to selectively open and/or close in response to a pressure differential between the at least one inlet and the at least one outlet. The at least one valve may be configured to selectively open and/or close in response to a pressure differential between the tracer release apparatus and the production tubing. The at least one valve may be configured to selectively open and/or close in response to a pressure differential between the fluid volume and the production tubing.

The at least one valve may be configured to selectively open and/or close by modifying the fluid pressure in the well, or by modifying the pressure differential between the at least one inlet and the at least one outlet, or by modifying the pressure differential between the tracer release apparatus and the production tubing and/or by modifying the pressure differential between the fluid volume and the production tubing.

The at least one valve may be a velocity valve. The at least one valve may be configured to selectively open and/or close in response to changes in fluid velocity in the production flow.

The at least one valve may be an electrically actuated valve. The at least one valve may be configured to selectively open and/or close in response to receiving at least one electric or electronic signal. The at least one valve may be wired or wirelessly controlled. The signal to control the actuation of the valve may be from the surface or from some other external source. The at least one valve may comprise or be connected to a wireless communication system. The wireless communications system may comprise at least one wireless receiver capable of wirelessly receiving data to control and operate the electrically actuated valve. The wireless communications system may comprise at least one transmitter to transmit a signal.

The at least one valve may be set to be normally open or normally closed. The at least one valve may be a flapper valve or a sleeve valve. The at least one valve may be adjustably set to be normally open or normally closed.

Preferably the at least one valve is configured to react to the fluid velocity and/or fluid pressure in the well. The at least one valve may be set to open and/or close at a predetermined fluid velocity or fluid pressure rate of flow. The valve may be configured to have at least one actuation threshold level.

The at least one valve may be set to partially open and/or partially close the valve. The valve may be configured to open and/or close the valve at intermediate positions between fully open and fully closed.

The at least one valve may comprise a biasing mechanism. The at least one valve may be balanced or biased by a biasing mechanism which is configured to set the valve with a pre-determined fluid velocity or fluid pressure level which must be reached before the valve is actuated. The biasing mechanism may be a spring. The biasing mechanism may be a coil spring, a wave spring, or a gas spring such as a nitrogen gas spring.

The biasing mechanism may be adjusted to set the actuation threshold of the valve. Preferably the valve is a biased by a spring which may be adjustable by changing the type, length, or tension of the spring. The actuation threshold of the valve may be set.

The at least one tracer release apparatus may be retrofitted into an existing tubing. The at least one tracer release apparatus may be retrievable, installed, replaced and/or adjusted by wireline, slickline, coiled tubing, drill pipe or similar conveyance. The at least one tracer release apparatus may be installed or replaced and may be conveyed through the production tubing by wireline, slickline, coiled tubing, drill pipe or similar conveyance. The at least one tracer release apparatus may be conveyed onto at least one landing nipple. The at least one landing nipple may have ports in communication with the production tubing and/or the annulus.

The at least one tracer release apparatus or a component of the at least one tracer release apparatus may be installed or replaced and may be conveyed through the production tubing by wireline, slickline, coiled tubing, drill pipe or similar conveyance.

The at least one valve may be retrofitted into an existing tracer release apparatus located downhole. The at least one valve may be retrievable, installed, replaced and/or adjusted by wireline, slickline, coiled tubing, drill pipe or similar conveyance. The at least one valve may be installed or replaced and may be conveyed through the production tubing by wireline, slickline, coiled tubing, drill pipe or similar conveyance. The at least one valve may be conveyed onto at least one landing nipple. The at least one landing nipple may have ports in communication with the production tubing and/or the annulus.

The valve settings of the at least one valve may be adjusted via direct connection from surface to the valve. The valve settings may be adjusted via an intervention operation by lowering an intervention device by wireline, slickline, coiled tubing, drill pipe or similar conveyance to manipulate and adjust the setting on the at least one valve.

The tracer release apparatus may comprise at least one flow restriction device. The at least one flow restriction device may be located in the tracer chamber. The least one flow restriction device may be located in the at least one inlet and/or in the at least one outlet.

The at least one flow restriction device may be selected from the group consisting of a nozzle, orifice, venturis, pitot tubes or a deviated pathway.

The at least one flow restriction device may be configured to control and/or delay the release of the tracer molecules from the tracer chamber of the tracer release apparatus into the production tubing. The at least one flow restriction device may be adjustable to change the release rate of the tracer molecules from the tracer chamber.

The at least one flow restrictor device may be adjusted to change the release of the tracer and/or to adjust the amplitude and/or duration of the tracer response spike at the detection point.

The release of the tracer from the tracer release apparatus to the production tubing may be delayed or prolonged by providing a flow restriction device. Increasing the resistance of the flow restriction device to the fluid flow through it results in an increase in time to flush-out the tracer.

Tracer release from the tracer release apparatus may create a characteristic signal called flush-out signal. The flush-out signal may have a peak concentration followed by the decay of the concentration. The decay of the concentration after the peak may be expressed by a slowly decaying function such as exponential function or power law function. The coefficient in the functions describing the steepness of the decay may be proportional to the fluid velocity inside the tracer release apparatus and thus the fluid velocity inside the tracer release apparatus can be calculated based on the measured tracer concentration decay curve. Steeper curve, i.e., shorter flush-out time, corresponds to the higher fluid velocity inside the tracer release apparatus.

The duration of the tracer signal may be captured by sampling or real time measurement. The signal should be long enough that it is not destroyed by the dispersion during the travel to the detection point which may be located after the upper completion and a long tie-back. Tracer release and dispersion may be modeled by flow models. The dispersion of the signal during the travel to the detection point may be compensated by modeling based on the well geometry and/or a model of the well.

The tracer release apparatus may comprise at least one inlet valve. The at least one inlet may control the flow of fluid through the at least one inlet. The tracer release apparatus may comprise an outlet valve to control the flow of fluid through the at least one outlet.

The at least one inlet and/or outlet may be configured to control the release of the tracer molecules from the tracer chamber of the tracer release apparatus into the production tubing. The at least one inlet and/or outlet may act as a restriction device and may be adjustable to change the release rate of the tracer molecules from the tracer chamber. The at least one inlet valve and the at least one outlet valve may be configured to act independently of one another. The at least one inlet valve and the at least one outlet valve may be configured to act in co-operation with one another. The at least one inlet valve and the at least one outlet valve may be configured such that one valve acts as a master valve and the other valve acts as a slave valve, such that the slave valve mimics the actions and responses of the master valve.

The at least one inlet and/or the at least one outlet may be in fluid communication with the production tubing. The at least one inlet and/or the at least one outlet may be in fluid communication with the annulus. The production tubing may be an inner pipe into which production fluid enters in the production zone. The production tubing may extend from downhole to surface.

The tracer release system may comprise two or more tracer release apparatus. The two or more tracer release apparatus may be configured for connection to a production tubing at different positions along the production tubing. The tracer release apparatus may be positioned downstream of an influx zone at known locations in the well. Each tracer chamber of the respective tracer release apparatus may comprise a distinct tracer material. Each tracer release apparatus may be arranged downstream of a different influx zone and exposed to the fluids from influx zone.

According to a second aspect of the invention, there is provided a method of releasing a tracer into a production flow comprising providing at least one tracer release apparatus connected to production tubing, the at least one tracer release apparatus comprising at least one outlet in fluid communication with the production flow at least one tracer chamber in fluid communication with the at least one outlet a tracer material disposed in the tracer chamber;

at least one valve configured to selectively control the flow of fluid through the at least one outlet; and opening the at least one valve to release tracer molecules from the at least one tracer chamber through the at least one outlet.

The at least one tracer release apparatus may comprise at least one inlet in fluid communication with the production flow. The at least one inlet may be in fluid communication with the at least one tracer chamber. The at least one valve may be configured to selectively control the flow of fluid through the at least one inlet. The method may comprise opening and/or closing the at least one valve in response to changes in fluid velocity or fluid pressure in the well. The method may comprise opening and/or closing the valve in response to a pressure differential between the at least one inlet and the at least one outlet. The method may comprise opening and/or closing the valve in response to a pressure differential between the tracer chamber of the tracer release apparatus and the production tubing.

The method may comprise creating a pressure differential between the at least one inlet and the at least one outlet. The pressure differential may be created by adjusting the flow rate of the production flow.

The method may comprise adjusting and/or setting at least one threshold fluid flow rate or pressure level to actuate the valve to selectively open and/or close the at least one outlet.

The method may comprise opening the at least one valve to an intermediate position between the fully open and fully closed positions.

The method may comprise closing the at least one valve for a period of time to shut in the tracer release apparatus and increase the concentration of tracer particles or molecules released into the fluid volume of the tracer chamber. The method may comprise closing the at least one valve for a period of time sufficient to build up a high or increased concentration of tracer molecules that is detectable as a high or increased amplitude tracer response signal at the detection point downstream when the tracer particles or molecules are released from the tracer release apparatus. By high or increased concentration it is referred to as an elevated concentration of tracer molecules when compared to the concentration of the tracer molecules present in well fluid which has not been shut in the tracer release apparatus.

The period of time the tracer release apparatus may be shut in may range from hours to months. The at least one valve may be closed for less than 24 hours to shut in the tracer chamber. The at least one valve may be closed for more than 24 hours to shut in the tracer release apparatus.

The method may comprise opening the valve to release fluid and tracer molecules from the tracer chamber of the tracer release apparatus through the at least one outlet into the production flow.

The method may comprise releasing the tracer molecules from the tracer chamber by flushing the fluid volume with production fluid entering the fluid volume of the tracer chamber.

The method may comprise adjusting the flow rate of the production flow to adjust the fluid flow velocity acting on the at least one valve. The method may comprise increasing the flow rate of the production flow to creating a pressure differential between the fluid volume of the tracer chamber and the production tubing. The method may comprise decreasing the flow rate of the production flow to create a pressure differential between the fluid volume of the tracer chamber and the production tubing.

The method may comprise restricting flow from the tracer chamber of the tracer release apparatus to the production tubing. The method may comprise restricting flow though the tracer release apparatus to control and/or delay the release of fluid from the tracer release apparatus into the production tubing.

Embodiments of the second aspect of the invention may include one or more features of the first aspect of the invention or its embodiments, or vice versa.

According to a third aspect of the invention, there is provided a method of estimating an influx profile for at least one of the well fluids to a producing well with two or more influx zones to a production flow comprising;

arranging two or more tracer release apparatus connected to the production tubing at known levels of the well;

wherein the tracer release apparatus comprises;

at least one outlet in fluid communication with the production flow;

at least one tracer chamber in fluid communication with the at least one outlet;

a distinct tracer material located in the at least one tracer chamber;

at least one valve configured to selectively control the flow of fluid through the at least one outlet;

opening the at least one valve to release tracer molecules from the tracer chamber into the production flow though the at least one outlet; and measuring the concentration of tracer and estimating an influx profile for at least one of the well fluids based on the type of tracer and the measured tracer concentrations.

The well fluids may be oil, water and/or gas. Each tracer release apparatus may be connected to the production tubing at a different influx zone location. By providing tracer release apparatuses at influx zones the contribution of each individual zone to total well production may be estimated and/or calculated.

The method may comprise analysing characteristics of the tracer release, sampling time, and/or cumulative produced volume of the influx volumes from different influx zones.

The at least one tracer release apparatus may comprise at least one inlet in fluid communication with the production flow. The at least one inlet may be in fluid communication with the at least one tracer chamber. The at least one valve may be configured to selectively control the flow of fluid through the at least one inlet.

The method may comprise closing the at least one valve for a period of time to shut in the tracer release apparatus and increase the concentration of tracer particles or molecules released into the fluid volume of the tracer chamber. The method may comprise closing the at least one valve for a period of time sufficient to build up a high or increased concentration of tracer molecules that can be detected downstream when the tracer molecules are released from the tracer release apparatus.

The method may comprise opening the at least one valve to release fluid and tracer molecules from the tracer release apparatus through the at least one valve outlet into the production flow.

The method may comprise opening the at least one valve by adjusting the fluid velocity and/or fluid pressure in the production tubing. The method may comprise closing the at least one valve by adjusting the fluid velocity and/or fluid pressure in the production tubing.

The method may comprise opening the at least one valve in response to a pressure differential between the at least one inlet and the at least one outlet. The method may comprise opening and/or closing the valve in response to a pressure differential between the tracer chamber and the production tubing.

The pressure differential may be created by adjusting the flow rate of the production flow. The method may comprise opening the at least one valve on each of the two or more tracer release apparatus at substantially the same time to release tracer molecules into the production flow.

The method may comprise adjusting and/or setting the valve to actuate above or below a predetermined production flow rate threshold or range. The method may comprise adjusting and/or setting the valve to actuate at multiple predetermined production flow rate thresholds or ranges.

The method may comprise releasing the tracer particles or molecules from the fluid volume of the tracer chamber of each tracer release apparatus by production fluid entering the tracer chamber via at least one inlet and/or outlet and flushing the tracer molecules from the tracer chamber.

The method may comprise adjusting the flow rate of the production flow to create a pressure differential to actuate the valve to close the inlet and/or outlet after the tracer molecules have been released from the tracer release apparatus.

The method may comprise controlling and/or delaying the release of fluid from the tracer release apparatus into the production tubing by restricting flow from the tracer release apparatus to the production tubing.

The method may comprise taking samples of well fluid downstream of the tracer release apparatus.

Samples of the well fluid may be taken at the surface or downhole. The samples may be collected for further analysis onsite or offsite. The sample of well fluid may be measured in real time.

The method may comprise creating at least one detectable tracer spike at a detection point downstream of the tracer release apparatus.

The method may comprise analysing the arrival of the concentration peaks of each tracer to determine the percent of inflow that occurs between tracer locations. The method may comprise analysing the rate of decline of the tracer concentration from each tracer location and/or tracer release apparatus location to determine the percent of reservoir inflow from each influx zone.

Samples may be collected and/or measured downstream at known sampling times. Based on the measured concentrations and their sampling sequence and the well geometry the influx volumes may be calculated. The influx volumes may be calculated from transient flow models. The influx volumes may be used to estimate the influx profile of the well.

The method may comprise using the calculated influx profile as parameters for controlling the production flow or for characterizing the reservoir.

The method may comprise modeling and/or interpreting the influx rates in a model well. The modeled influx profile and/or rates may be adjusted until the calculated concentrations of model tracers compare with the measured concentrations of identified tracers to estimate an influx profile.

Embodiments of the third aspect of the invention may include one or more features of the first or second aspects of the invention or their embodiments, or vice versa.

According to a fourth aspect of the invention, there is provided a method of monitoring influx of a fluid to a hydrocarbon producing well, the method comprising:

providing at least one tracer release apparatus connected to a production tubing in a hydrocarbon producing well at an influx location, the tracer release apparatus comprising: a fluid volume; a tracer material located in the fluid volume; an outlet to the fluid volume; and a controllable valve configured to selectively control the flow of fluid through the outlet;

wherein the tracer release apparatus has a first condition in which the controllable valve is closed to substantially or fully prevent fluid and tracer from passing from the fluid volume to the production fluid via the outlet, and a second condition in which the controllable valve is open to enable fluid and tracer molecules to pass from the fluid volume to the production tubing via the outlet;

the method comprising:

producing hydrocarbons from the well with the tracer release apparatus in its first condition at a first production flow rate in the production tubing;

modifying the production flow rate in the production tubing to a second production flow rate to actuate the controllable valve to cause fluid and the tracer material to flow from the fluid volume to the production tubing, creating an increased concentration of tracer in the production tubing; and detecting the presence of tracer in the production flow downstream of the influx location.

The method may comprise detecting the presence of tracer at a detection location. The detection location may be a downhole location, or may be a surface location, or may be at a location in a direction towards the surface of the production well.

The method may comprise modifying the production flow rate in the production tubing to a third production flow rate to actuate the controllable valve to close to prevent fluid and tracer from passing from the fluid volume to the production fluid via the outlet. The second production flow rate may be higher than the first production flow rate. Alternatively, the second production flow rate may be lower than the first production flow rate.

The third production flow rate may be lower than the second production flow rate. Alternatively, the third production flow rate may be lower than the second production flow rate.

Preferably the tracer release apparatus has an inlet to the fluid volume. The fluid volume may be a tracer chamber.

The method may comprise actuating the controllable valve to open the inlet and/or outlet. The method may comprise actuating the controllable valve to close the inlet and/or outlet. The controllable valve may be disposed in the outlet between the fluid volume and the production tubing. The controllable valve may be disposed in the inlet between the fluid volume and the production tubing.

The apparatus may comprise a first controllable valve disposed in the outlet between the fluid volume and the production tubing and a second controllable valve disposed in the inlet between the fluid volume and the production tubing. The method may comprise actuating the controllable valve to open the inlet and/or outlet. The method may comprise actuating the controllable valve to close the inlet and/or outlet.

The first, second and third production flow rates may be non-zero flow rates. At least one of the first, second and third production flow rates may be a zero flow rates.

The production flow rate may be modified by operation of a choke connected to the production tubing. The choke may be a subsea choke or a surface choke. The choke may be a downhole choke.

The third production flow rate may be substantially the same as the first production flow rate. Thus, the controllable valve may be actuated to open by a temporary modification of a production flow rate to a higher or lower production flow rate.

The tracer release apparatus may have a third condition in which the controllable valve is at an intermediate position between the fully open and fully closed to enable the throttling of flow of the fluid and tracer materials passing from the fluid volume to the production tubing via the outlet.

By providing a tracer release apparatus capable of being shut in and controlling the building up and selective release of a high or increased concentration of tracer a detectable level of tracer may be monitored downstream as required.

The method may also extend the lifespan of downhole tracer as the exposure of the tracer material to production flow may be controlled. During a shut in of the tracer release apparatus the tracer molecules may be released into the fluid volume of the apparatus until the fluid volume becomes enriched with tracer molecules. The fluid volume may be enriched or saturated with tracer molecules after which the release of tracer into the fluid volume is substantially or fully stopped.

The method may also allow tracer systems or tracer types which previously have been considered unsuitable due to a high of rate of release from a tracer source into a target fluid in downhole conditions to be used. In fact, the high release rate of such tracers may allow high tracer concentrations to be built up in a short period of time. This may be beneficial where tracer release operations are required in quick succession.

The method may comprise collecting samples of the production flow. The sampling may be conducted at the one or more sampling times. The sampling may be conducted downhole downstream of the tracer release apparatus or at surface. Samples may be collected for later analysis.

The detection and/or analysis of tracer in production fluid may be a separate method to the release of tracer from the tracer release apparatus and/or the collection of samples. Samples may be collected and the tracer detected at a time or jurisdiction which is separate and distinct from the location of well and therefore the collection of the samples.

The method may comprise monitoring influx of a fluid to a hydrocarbon producing well in real time. The method may comprise conducting optical monitoring for detection of the tracers in the production flow. The method may comprise determining the type of tracer. The method may comprise the monitoring the concentration of tracer. The method may comprise monitoring the arrival times of the tracer.

The method may comprise estimating or calculating an influx profile based on the concentration and type of tracer as a function of the sampling time.

Embodiments of the fourth aspect of the invention may include one or more of any of features of the first to third aspects of the invention or their embodiments, or vice versa.

According to a fifth aspect of the invention, there is provided a method of monitoring influx of a fluid to a hydrocarbon producing well, the method comprising:

providing at least one tracer release apparatus connected to a production tubing in a hydrocarbon producing well at an influx location, the tracer release apparatus comprising: a fluid volume; a tracer material located in the fluid volume; an outlet to the fluid volume; and a controllable valve configured to selectively control the flow of fluid through the at least one outlet;

wherein the tracer release apparatus has a first condition in which the controllable valve is open to enable fluid and tracer to pass from the fluid volume to the production tubing via the outlet, and a second condition in which the controllable valve is closed to substantially or fully prevent fluid and tracer from passing from the fluid volume to the production fluid via the outlet;

the method comprising:

producing hydrocarbons from the well with the tracer release apparatus in its first condition at a first production flow rate in the production tubing;

modifying the production flow rate in the production tubing to a second production flow rate to actuate the controllable valve to prevent fluid and tracer from passing from the fluid volume to the production fluid via the outlet;

modifying the production flow rate in the production tubing to a third production flow rate to actuate the controllable valve to actuate the controllable valve to cause fluid and the tracer to flow from the fluid volume to the production tubing, creating an increased concentration of tracer in the production tubing;

detecting the presence of tracer downstream of the influx location.

The second production flow rate may be higher than the first production flow rate. Alternatively, the second production flow rate may be lower than the first production flow rate. The third production flow rate may be lower than the second production flow rate. Alternatively, the third production flow rate may be lower than the second production flow rate.

Preferably the tracer release apparatus has an inlet to the fluid volume.

The method may comprise actuating the controllable valve to open the inlet and/or outlet. The method may comprise actuating the controllable valve to close the inlet and/or outlet. The controllable valve may be disposed in the outlet between the fluid volume and the production tubing. The controllable valve may be disposed in the inlet between the fluid volume and the production tubing.

The first, second and third production flow rates may be non-zero flow rates. At least one of the first, second and third production flow rates may be a zero flow rates.

The production flow rate may be modified by operation of a choke connected to the production tubing. The choke may be a subsea choke or a surface choke. The choke may be a downhole choke.

The third production flow rate may be substantially the same as the first production flow rate. Thus, the controllable valve may be actuated to open by a temporary modification of a production flow rate to a higher or lower production flow rate.

The tracer release apparatus may have a third condition in which the controllable valve is at an intermediate position between the fully open and fully closed to enable the throttling of flow of the fluid and tracer materials passing from the fluid volume to the production tubing via the outlet.

By providing a tracer release apparatus which is capable of controlling the building up and selective release of a high concentration of tracer a detectable level of tracer may be released as required without requiring the shutdown of the well.

Embodiments of the fifth aspect of the invention may include one or more of any of features of the first to fourth aspects of the invention or their embodiments, or vice versa.

According to a sixth aspect of the invention there is provided a method of monitoring influx of a fluid to a hydrocarbon producing well, the method comprising:

providing two or more tracer release apparatus connected to a production tubing in a hydrocarbon producing well each tracer release apparatus at a different influx location, the tracer release apparatus comprising;

a fluid volume; a tracer material located in the fluid volume; an outlet to the fluid volume; and a controllable valve configured to selectively control the flow of fluid through the at least one outlet;

wherein each tracer release apparatus has a first condition in which the controllable valve is closed to substantially or fully prevent fluid and tracer from passing from the fluid volume to the production fluid via the outlet, and a second condition in which the controllable valve is open to enable fluid and tracer to pass from the fluid volume to the production tubing via the outlet;

the method comprising;

producing hydrocarbons from the well with the tracer release apparatus in its first condition at a first production flow rate in the production tubing;

modifying the production flow rate in the production tubing to a second production flow rate to actuate the controllable valve to cause fluid and the tracer to flow from the fluid volume to the production tubing, creating an increased concentration of tracer in the production tubing; and detecting the presence of tracer downstream of the influx location at a detection location in a direction towards the surface of the production well.

The method may comprise modifying the production flow rate in the production tubing to a third production flow rate to actuate the controllable valve to prevent fluid and tracer material from passing from the fluid volume to the production fluid via the outlet. The second production flow rate may be higher than the first production flow rate. Alternatively, the second production flow rate may be lower than the first production flow rate. The third production flow rate may be lower than the second production flow rate.

Alternatively, the third production flow rate may be lower than the second production flow rate.

The method may comprise opening the controllable valve for each tracer release apparatus simultaneously to enable fluid and tracer materials to pass from the fluid volume to the production tubing via the outlet of each tracer release apparatus.

The third production flow rate may be substantially the same as the first production flow rate. Thus, the controllable valve may be actuated to open by a temporary modification of a production flow rate to a higher or lower production flow rate.

Embodiments of the sixth aspect of the invention may include one or more of any of features of the first to fifth aspects of the invention or their embodiments, or vice versa.

According to a seventh aspect of the invention there is provided a method of monitoring influx of a fluid to a hydrocarbon producing well, the method comprising:

providing two or more tracer release apparatus connected to a production tubing in a hydrocarbon producing well each tracer release apparatus at a different influx location, the tracer release apparatus comprising:

a fluid volume; a tracer material located in the fluid volume; an outlet to the fluid volume; and a controllable valve configured to selectively control the flow of fluid through the at least one outlet;

wherein each tracer release apparatus has a first condition in which the controllable valve is open to enable fluid and tracer to pass from the fluid volume to the production tubing via the outlet, and a second condition in which the controllable valve is closed to substantially or fully prevent fluid and tracer from passing from the fluid volume to the production fluid via the outlet;

the method comprising:

producing hydrocarbons from the well with two or more tracer release apparatus in a first condition at a first production flow rate in the production tubing;

modifying the production flow rate in the production tubing to a second production flow rate to actuate the controllable valve in each tracer release apparatus to prevent fluid and tracer from passing from the fluid volume to the production fluid via the outlet;

modifying the production flow rate in the production tubing to a third production flow rate to actuate the controllable valve in each tracer release apparatus to actuate the controllable valve to cause fluid and the tracer to flow from the fluid volume to the production tubing, creating an increased concentration of tracer in the production tubing;

detecting the presence of each tracer downstream of the influx location.

The second production flow rate may be higher than the first production flow rate. Alternatively, the second production flow rate may be lower than the first production flow rate. The third production flow rate may be lower than the second production flow rate. Alternatively, the third production flow rate may be lower than the second production flow rate.

The method may comprise modifying the production flow rate in the production tubing to a fourth or further production flow rate to actuate controllable valves in one or more of the release tracer apparatus to prevent fluid and tracer molecules from passing from the fluid volume to the production fluid via the outlet.

Embodiments of the seventh aspect of the invention may include one or more of any of features of the first to sixth aspects of the invention or their embodiments, or vice versa.

According to an eighth aspect of the invention there is provided a method of monitoring influx of a fluid to a hydrocarbon producing well, the method comprising:

providing at least one tracer release apparatus connected to a production tubing in a hydrocarbon producing well at an influx location, the tracer release apparatus comprising:

a fluid volume;

a tracer material located in the fluid volume;

an outlet to the fluid volume;

and a controllable valve configured to selectively control the flow of fluid through the outlet;

modifying the production flow rate between a first production flow rate at which the controllable valve is closed to shut in the fluid volume and substantially or fully prevent fluid and tracer from passing from the fluid volume to the production fluid via the outlet; and second production flow rate at which the controllable valve is actuated to cause fluid and the tracer to flow from the fluid volume to the production tubing, creating an increased concentration of tracer in the production tubing;

and detecting the presence of tracer downstream of the influx location.

During normal production the flow rate may be at the first production flow rate and the valve is closed during normal production flow in the well. The at least one tracer release apparatus is shut in over a long period of time. The method may comprise opening the valve by a temporary modification of a production flow rate to a higher or lower production flow rate.

The method may comprise modifying the production flow rate to a third production rate at which the controllable valve is closed to shut in the fluid volume and substantially or fully prevent fluid and tracer material from passing from the fluid volume to the production fluid via the outlet. The third production flow rate may be substantially the same as the first production flow rate.

During normal production the flow rate may be at the second production flow rate and the valve is open during normal production flow in the well. The method may comprise temporarily closing the valve by a temporary modification of a production flow rate to a higher or lower production flow rate. The at least one tracer release apparatus is shut in over a short temporary period of time.

The modification of the production flow rate between the first and second production rates may be repeated to repeat the actuation of the valve to shut in and subsequently release the tracer.

Embodiments of the eighth aspect of the invention may include one or more of any of features of the first to seventh aspects of the invention or their embodiments, or vice versa.

According to a ninth aspect of the invention there is provided a method of releasing a tracer into a production flow of a hydrocarbon producing well, the method comprising:

providing at least one tracer release apparatus connected to a production tubing in a hydrocarbon producing well at an influx location;

the tracer release apparatus comprising:

a fluid volume; a tracer material located in the fluid volume; an outlet to the fluid volume; and a controllable valve configured to selectively control the flow of fluid through the at least one outlet;

inducing a transient in the production flow to release at least one tracer from the at least one tracer release apparatus into the production tubing.

The method may comprise inducing a transient to actuate the controllable valve to release at least one tracer from the at least one tracer release apparatus into the production tubing. The method may comprise modifying the production flow rate to induce a transient in the production flow.

Embodiments of the ninth aspect of the invention may include one or more of any of features of the first to eighth aspects of the invention or their embodiments, or vice versa.

According to a tenth aspect of the invention there is provided a method of collecting samples for analysis in estimating an influx profile of a hydrocarbon producing well, the method comprising;

providing at least one tracer release apparatus connected to a production tubing in a hydrocarbon producing well at an influx location;

the tracer release apparatus comprising:

a fluid volume; a tracer material located in the fluid volume; an outlet to the fluid volume; and a controllable valve configured to selectively control the flow of fluid through the at least one outlet;

inducing a transient in the production flow to release at least one tracer from the at least one tracer release apparatus; and collecting samples (c) at a location downstream of the tracer sources after inducing the transient in the production flow.

The method may comprise inducing a transient to actuate the controllable valve to release at least one tracer from the at least one tracer release apparatus into the production tubing Embodiments of the tenth aspect of the invention may include one or more of any of features of the first to ninth aspects of the invention or their embodiments, or vice versa.

According to an eleventh aspect of the invention there is provided a method of estimating an influx profile for at least one of the well fluids to a producing well with at least one influx zones to a production flow comprising;

arranging at least one tracer release apparatus connected to the production tubing at known levels of the well, wherein the tracer release apparatus comprises;

a fluid volume; a tracer material located in the fluid volume; an outlet to the fluid volume; and a controllable valve configured to selectively control the flow of fluid through the at least one outlet;

opening the at least one valve to release tracer molecules from the tracer chamber into the production flow though the at least one outlet; and measuring the concentration of tracer and estimating an influx profile for at least one of the well fluids based on the type of tracer and the measured tracer concentrations.

The method may comprise analysing characteristics of the tracer release, sampling time, and/or cumulative produced volume of the influx volumes from different influx zones.

The method may comprise analysing the arrival of the concentration peaks of each tracer to determine the percent of inflow that occurs between tracer locations. The method may comprise analysing the rate of decline of the tracer concentration from each tracer location and/or tracer release apparatus location to determine the percent of reservoir inflow from each influx zone.

The method may comprise using the calculated influx profile as parameters for controlling the production flow or for characterizing the reservoir.

The method may comprise modeling the influx rates in a model well. The modeled influx profile and/or rates may be adjusted until the calculated concentrations of model tracers compare with the measured concentrations of identified tracers to estimate an influx profile.

Embodiments of the eleventh aspect of the invention may include one or more of any of features of the first to tenth aspects of the invention or their embodiments, or vice versa.

According to a twelfth aspect of the invention there is provided a of monitoring influx of a fluid to a hydrocarbon producing well, the method comprising:

providing at least one tracer release apparatus in a hydrocarbon producing well at an influx location; wherein the at least one tracer release apparatus comprises:

a fluid volume; and a tracer material located in the fluid volume;

shutting in the tracer release apparatus during production to build a high concentration of tracer molecules in the fluid volume;

releasing the high concentration of tracer molecules from the tracer release apparatus into the production flow; and detecting the presence of tracer downstream of the influx location.

The method may comprise shutting in the tracer release apparatus to limit the exposure of the tracer to the production flow. The method may comprise shutting in the tracer release apparatus at a first production flow rate. The method may comprise releasing the high concentration of tracer molecules from the tracer release apparatus at a second production flow rate.

The at least one tracer release apparatus may comprise at least one controllable valve. The method may comprise modifying the production flow rate in the production tubing to actuate the at least one controllable valve to shut in the tracer release apparatus and/or to release the high concentration of tracer molecules from the tracer release apparatus.

Embodiments of the twelfth aspect of the invention may include one or more of any of features of the first to eleventh aspects of the invention or their embodiments, or vice versa.

BRIEF DESCRIPTION OF THE DRAWINGS

There will now be described, by way of example only, various embodiments of the invention with reference to the drawings, of which.

DETAILED DESCRIPTION OF PREFERRED EMBODIMENTS

Figure 1:
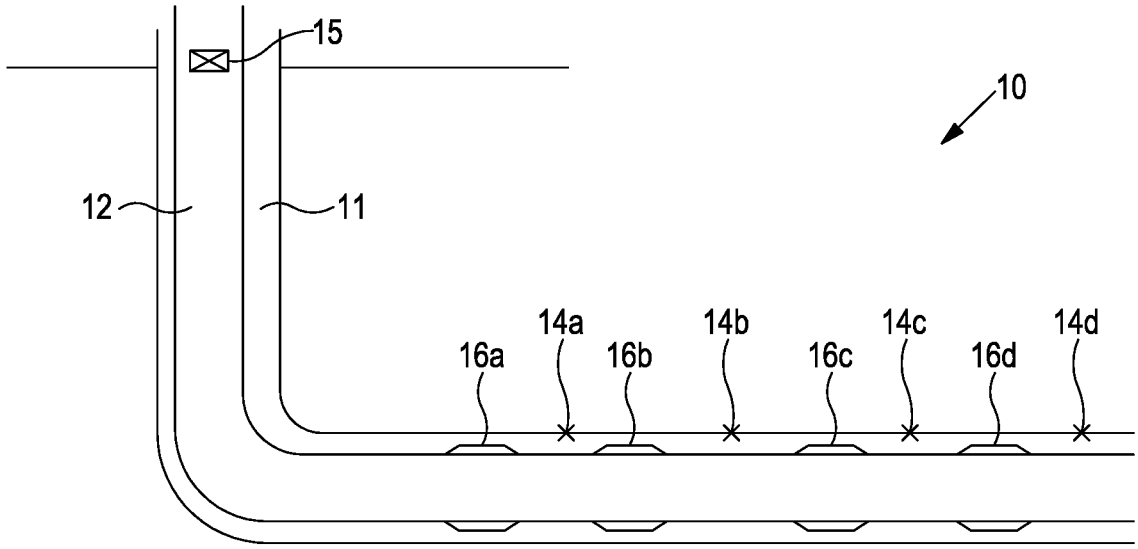
FIG. 1 is a simplified sectional diagram through a production well with a tracer release system installed in accordance with an aspect of the invention.

FIG. 1 is a simplified section through a production well 10. A central production tubing 12 is arranged in the well surrounded by annulus 11. Influx volumes of fluids enter the well from a reservoir into the central production tubing 12 via separate influx locations. Tracers release apparatus 16 are installed in or on the production tubing and are arranged near each influx location. Tracers are released and measured at surface to provide information on which influx locations are producing and the rates of influx. In this example, there are four influx locations 14*a*, 14*b*, 14*c* and 14*d* and four tracer release apparatus 16*a*, 16*b*, 16*c* and 16*d* each with a tracer source with distinct tracer material distinct for each influx location. However, there may be a different number of influx zones and/or tracer release apparatus than illustrated in FIG. 1. An adjustable choke assembly 15 is arranged to control the production flow rate. In FIG. 1 the adjustable choke assembly 15 is connected to the production tubing to control the fluid flow rate or downstream system pressure in the production tubing. However, it will be appreciated that the choke may be located at different positions in the well.

Arrows in the examples below denote the direction of fluid travel and are indicative of flow velocity (for example two arrows indicates a high flow rate than one arrow and vice versa).

Figure 2A:
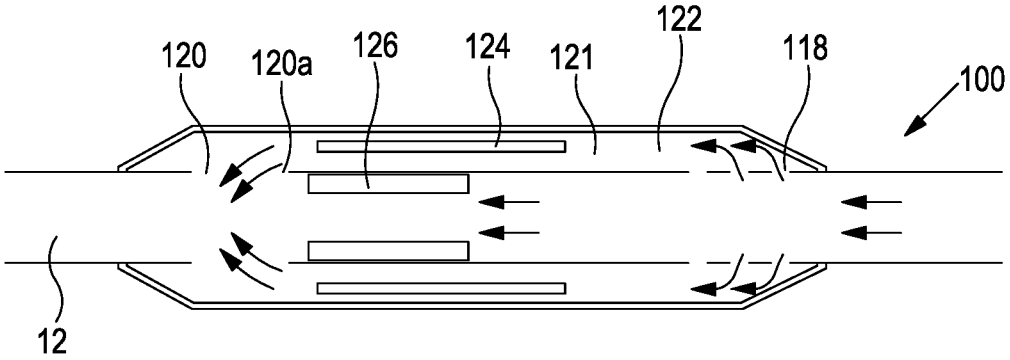
FIGS. 2A to 2C are enlarged sectional views of a tracer release apparatus of the tracer release system of FIG. 1 showing operational steps for a short tracer release apparatus shut in in a well with a normally high production rate.
Figure 2B:
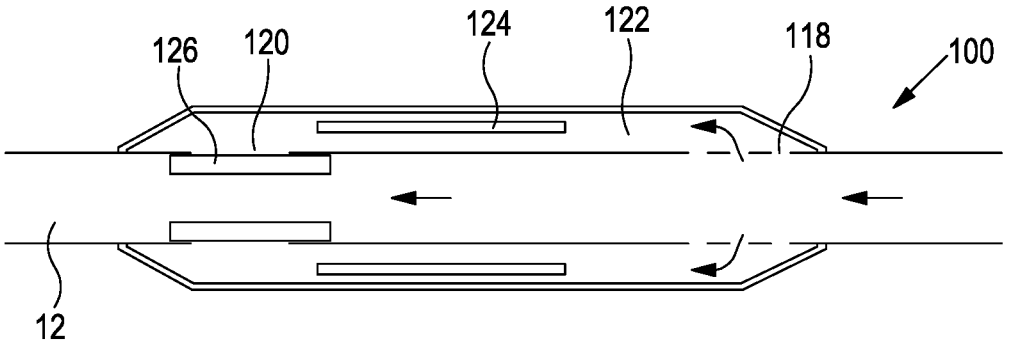
Figure 2C:
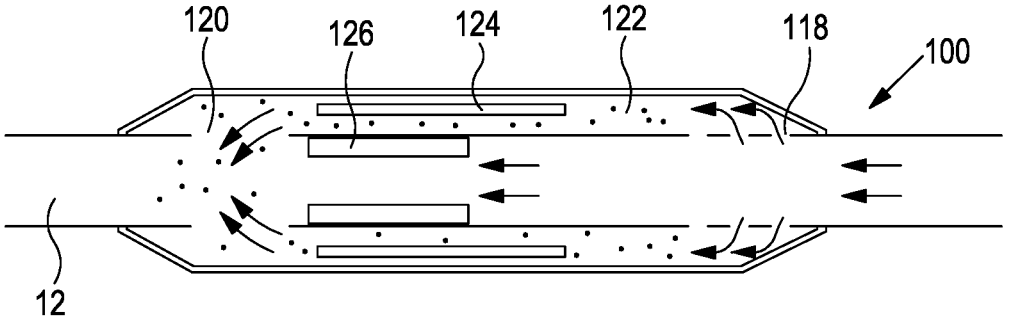

FIGS. 2A to 2C show enlarged sections of a tracer release apparatus 100. The tracer release apparatus is installed on or in a production tubing 12. The tracer release apparatus has an inlet 118 and an outlet 120 in fluid communication with a production pipe 12. The tracer release apparatus 100 surrounding the production tubing has an annulus tracer chamber 121 with a fluid volume 122 which comprises a tracer material 124. The tracer material may be disposed in the fluid volume to allow fluid to contact the tracer material and pass around the tracer material in the fluid volume 122. The tracer material 124 is designed to release tracer molecules or particles when exposed to a target well fluid i.e. oil, gas or water.

A valve assembly 126 is fixed with a movably closure member for selectively opening and closing the outlet aperture 120*a* to control the flow of fluid from the fluid volume 122 to the production pipe.

In the examples show in FIGS. 2A to 2C, the valve assembly is mounted on an outside wall of the tracer chamber. However, it will be appreciated that the valve assembly may be mounted on an inside wall of the tracer chamber.

In this example the valve assembly 126 is a differential pressure operated valve designed to open and close in response to changes in differential pressure between the production tubing and the tracer release apparatus. In this case the change in differential pressure is controlled by adjusting the production flow rate. The valve assembly is set to open above a pre-set production flow rate threshold and close below the set threshold.

During normal production as shown in FIG. 2A the production flow rate is above the pre-set flow rate threshold and therefore the differential pressure valve remains open. Fluid passes from the production pipe through inlet 118 into the fluid volume 122 of tracer chamber. The tracer material is exposed to the fluid and tracer particles are released into the fluid. The tracer enriched fluid passes through the outlet into the production pipe and it carried by the production fluid to surface.

To shut in the tracer release apparatus a choke assembly (not shown) connected to the production tubing is adjusted to reduce the production flow to a second flow velocity. The second flow velocity is lower than the pre-set threshold for the valve assembly and the valve closes which selectively closes the outlet 120.

Fluid in the fluid volume 122 is prevented from exiting the tracer chamber. The tracer material 126 remains exposed to a volume of fluid over the period of time that the valve assembly is closed building up a high concentration of the tracer particles 126*a* in the fluid volume. Depending on the tracer type, its release rate into the target fluid and the period of time the valve assembly is closed determines the saturation or enrichment level of the fluid volume with tracer.

To open the valve the choke assembly is adjusted to increase the production flow rate above the pre-set threshold for the valve. As shown in FIG. 2C the valve assembly is opened allowing fluid and high concentration of tracer to pass through the outlet 122 into the production tubing 12. The high concentration of the tracer, also known as a tracer cloud, is carried to the surface where samples of fluid are taken. The tracer cloud creates a high amplitude spike signal at a detection point and the concentration of tracer determined.

The tracer transients formed by the shut-in of the tracer release apparatus, build up tracer concentration and subsequent release propagate to the surface as high concentration tracer clouds, slugs or shots. The tracer transients are driven by the velocity field in the well. The topside arrivals of the onset of the different tracers, or the full transient of the different tracers, can be used to estimate the downhole velocity field. From the velocity field the inflow profile may be calculated.

Figure 3A:
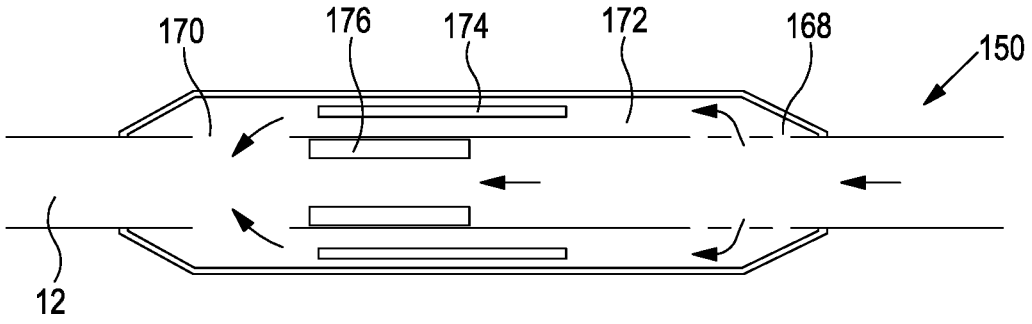
FIGS. 3A to 3C are enlarged sectional views of a tracer release apparatus of the tracer release system of FIG. 1 showing operation steps for a short tracer release apparatus shut in in a well with a normally low production rate.
Figure 3B:
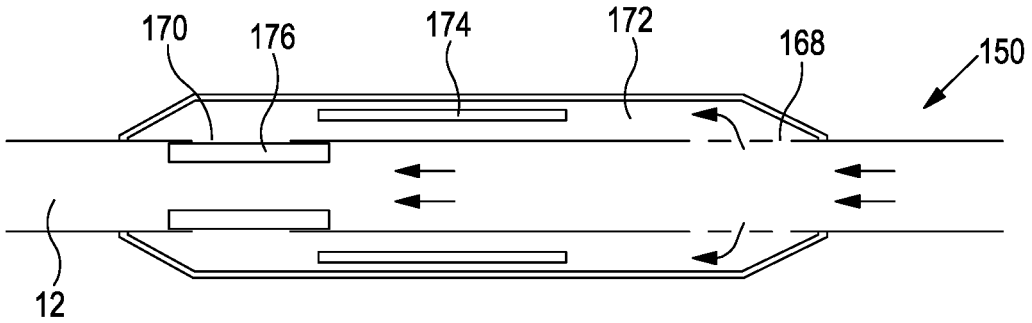
Figure 3C:
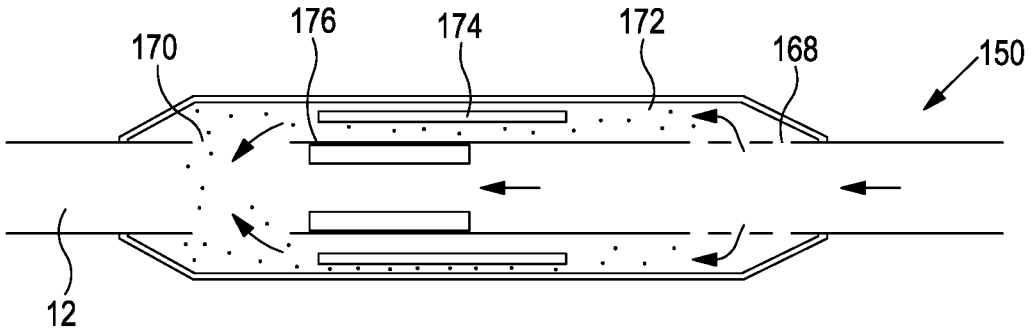

FIG. 3A to 3C describes an inverse valve assembly arrangement to the tracer release apparatus 100 described in FIGS. 2A to 2C. In FIGS. 3A to 3C the tracer release apparatus 150 has a differential pressure valve 176 which is configured to close above a pre-set production flow rate threshold and open below the pre-set threshold rate. During normal low production flow rate as shown in FIG. 3A, the production flow rate is below the valve pre-set production flow rate threshold and therefore the valve 176 remains open. Fluid passes from the production pipe through inlet 168 into the fluid volume 172.

To shut in the tracer release apparatus 150 a choke assembly (not shown) connected to the production pipe is adjusted to increase the production flow to a second flow velocity which in this case is higher than the pre-set threshold for the valve 176. The valve is actuated which closes the outlet 170. The tracer material remains exposed to a volume of fluid over the period of shut in of the tracer release apparatus building up a high concentration of the tracer particles in the fluid volume.

To open the outlet 170, the choke assembly is adjusted to reduce the production flow rate below the pre-set threshold as shown in FIG. 3C. The valve is actuated to open the outlet allowing fluid and high concentration of tracer to pass through the outlet 170 into the production tubing. The high concentration of the tracer is flushed out of the tracer chamber 172 by the inflow of production fluid into the tracer chamber via the inlet 168. The high concentration tracer in the form of a tracer cloud is carried to the surface.

The above embodiment has application in wells where sand mitigation may be an issue at high production rates.

Figure 4A:
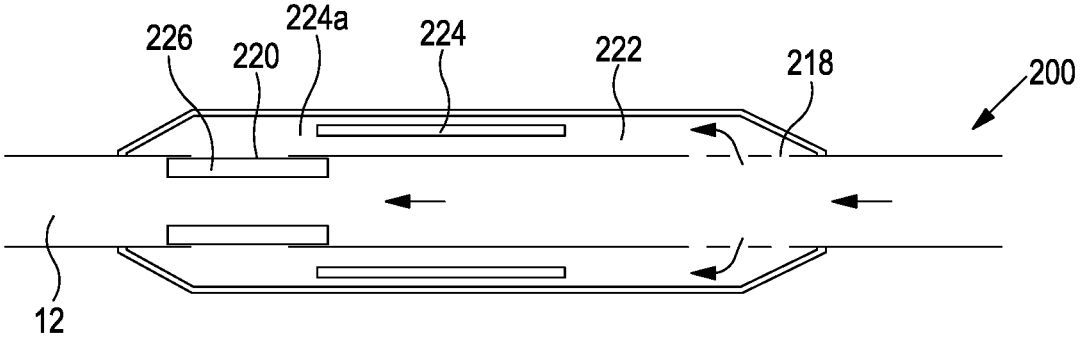
FIGS. 4A to 4C are enlarged sectional views of a tracer release apparatus of the tracer release system of FIG. 1 showing operation steps for a long tracer release apparatus shut in in a well with a normally low production rate.
Figure 4B:
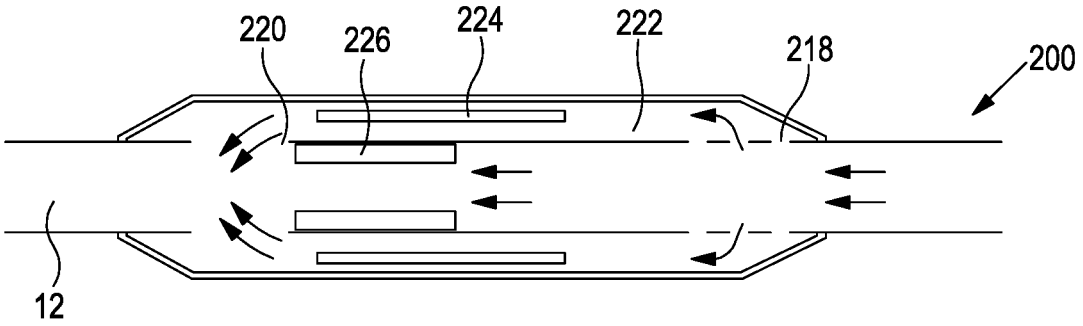
Figure 4C:
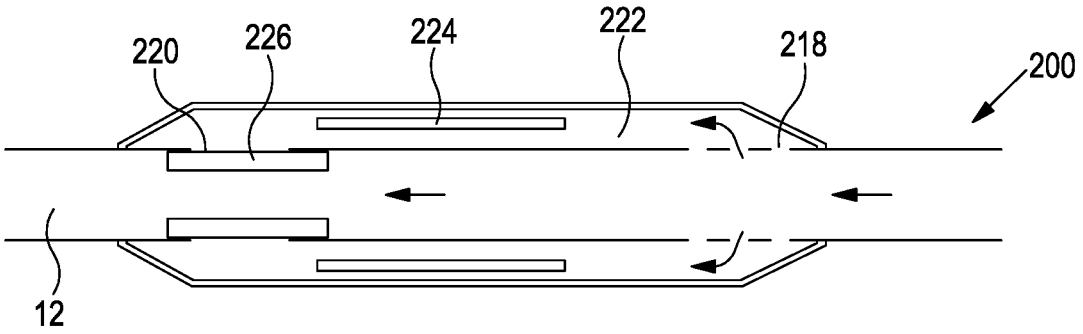

FIG. 4A to 4C shows an alternate arrangement of a tracer release apparatus 200. The differential pressure valve 226 is configured to open above a pre-set production flow rate threshold and close below the threshold rate.

During normal low production flow rate the flow rate is below the pre-set production flow rate threshold and therefore the valve 226 remains closed. Tracer material 224 in the fluid volume of the tracer chamber remains exposed to a volume of fluid in the tracer chamber 222 over the period of time that the valve 226 is closed, building up an increased concentration of the tracer molecules 224*a* in the inner fluid volume of the tracer release apparatus.

When a tracer analysis operation is required, the choke assembly is temporarily adjusted to increase the production flow rate to a second flow velocity which it higher than the pre-set threshold for the valve 226, the valve 226 opens the outlet 220 releasing the fluid and high or increased concentration of tracer molecules in the form of a tracer cloud into the production tubing 12. The tracer cloud is carried to surface by the production fluid.

To shut in the release apparatus the choke assembly is adjusted to reduce the production flow to a flow velocity which it lower than the pre-set threshold for the valve assembly, the valve assembly closes the outlet 220 shutting in the tracer release apparatus and allowing the tracer concentration to build up.

By exposing tracer to production flow only when a tracer analysis operation is required and a tracer cloud is to be released the lifespan of the tracer may be extended. The small volume of fluid in the fluid volume of the tracer chamber may quickly become enriched with tracer particles. As the small volume of fluid becomes enriched or saturated the tracer particle release rate from the tracer material is reduced.

This may allow a wide range of tracer types to be used including fast release tracer polymer systems. By providing fast release tracer polymer systems in the tracer release apparatus it avoids significant time lags between tracer analysis operations. This contrasts with the standard practice of extending tracer lifespan by reducing tracer release rate so that it lasts as long as possible downhole.

Figure 5A:
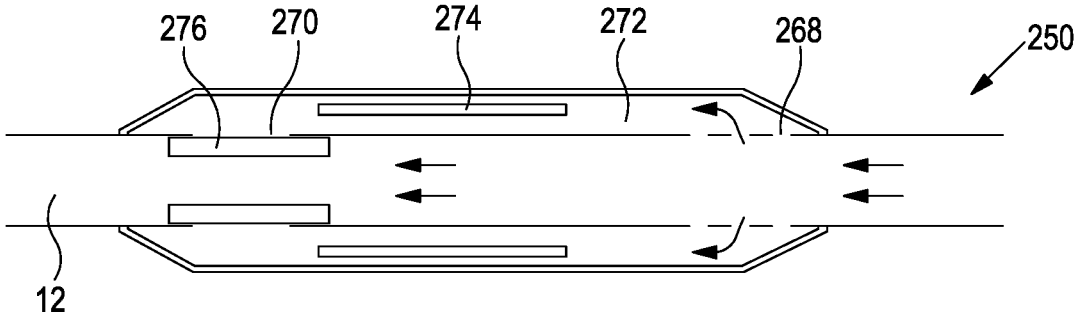
FIGS. 5A to 5C are enlarged sectional views of a tracer release apparatus of the tracer release system of FIG. 1 showing operation steps for a long tracer release apparatus shut in in a well with a normally high production rate.
Figure 5B:
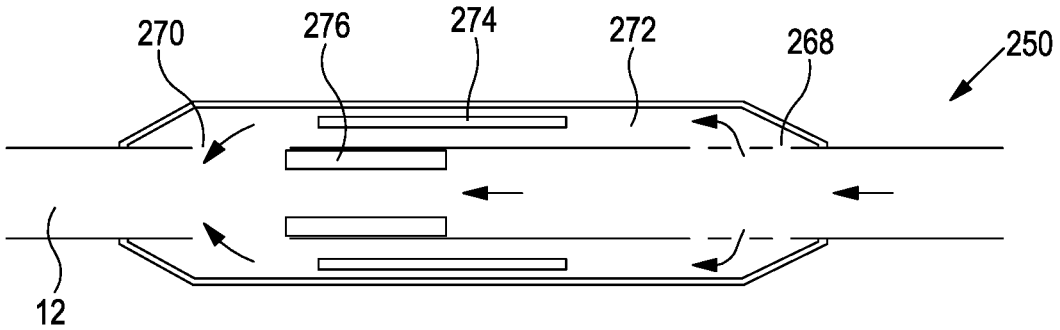
Figure 5C:
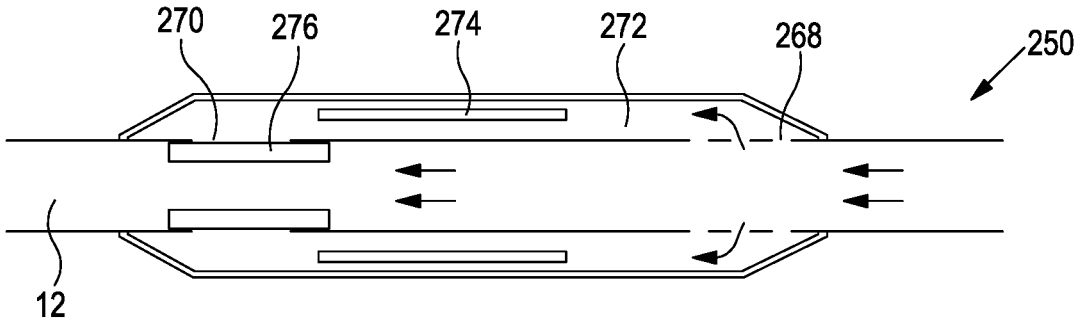

FIG. 5A to 5C describes an inverse valve assembly arrangement for high production rate to FIGS. 4A to 4C. In FIGS. 5A to 5C the tracer release apparatus 250 has a valve assembly 276 configured to open below a pre-set production flow rate threshold and close above the threshold rate.

During normal high flow rate production as shown in FIG. 5A, the production flow rate is above the pre-set production flow rate threshold and therefore the valve 276 remains closed. Tracer material in the tracer chamber remains exposed to a volume of fluid and a high concentration of the tracer particles in the fixed fluid volume builds up.

To actuate the valve 276 to open the outlet 270 a choke assembly is temporality adjusted to reduce the production flow to a flow velocity which it lower than the pre-set threshold for the valve 276, the valve assembly opens releasing the tracer cloud into the production flow.

When the choke assembly is adjusted to back to the normal production flow rate which is above the valve threshold level, the valve 276 is actuated to close the outlet.

Figure 6A:
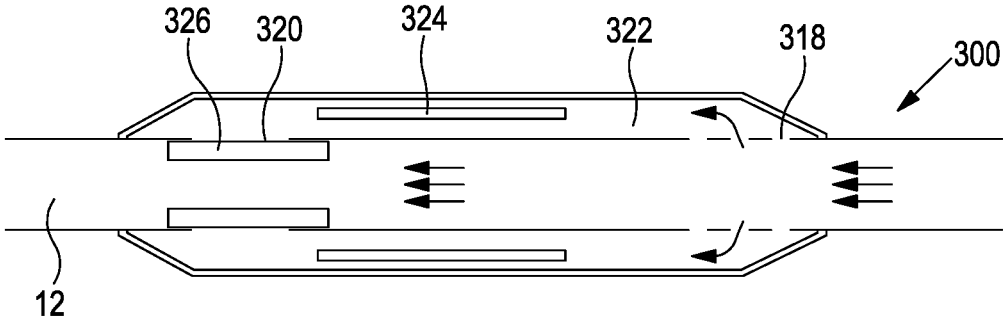
FIGS. 6A to 6C are enlarged sectional views of a tracer release apparatus of the tracer release system of FIG. 1 showing operation steps in shutting the tracer release apparatus at two valve thresholds.
Figure 6B:
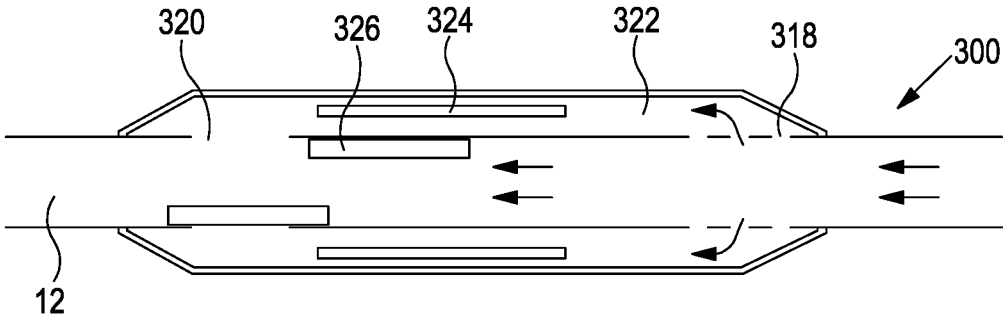
Figure 6C:
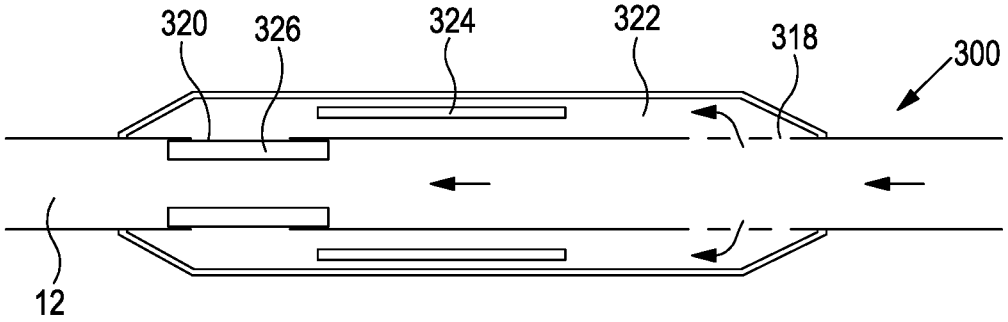

FIGS. 6A to 6C shows an alternative arrangement of the tracer release apparatus 200 of FIG. 2A and will be understood from the description of FIGS. 2A to 2C above.

However, the tracer release apparatus 300 has a differential pressure valve 326 with two adjustable actuation threshold levels to actuate the valve 326 to close the outlet 320. The valve is set so that the it closes the outlet 320 above a first pre-set production flow rate threshold and below a second pre-set production flow rate threshold. The valve 326 is therefore configured to open over a flow rate range between the two threshold levels.

During normal high production the flow rate as shown in FIG. 6A, the flow rate is above the first pre-set production flow rate threshold and therefore the valve 326 is actuated to close the outlet 320. However, adjusting the production choke to reduce the production rate below the pre-set production flow rate threshold actuates the valve to open the outlet and allows the tracer cloud to be released as shown in FIG. 6B.

Further adjusting the choke to reduce the production rate below the second pre-set production flow rate threshold actuates the valve to close the outlet. This means that should the well be shut in the valve closes the outlet and limits the volume of fluid the tracer material contacts thereby extending the lifespan of the tracer.

FIGS. 7A to 10D show different operations of two tracer release apparatus to release tracer into the production flow. In wells with more than one tracer release apparatus the valve assemblies for each tracer release apparatus may be arranged to release the built up tracer molecules concentration (tracer cloud) simultaneously.

FIGS. 7A to 7D show stages of the operation of valve assemblies for synchronised release of tracer from two tracer release apparatus in a well.

Figure 7A:
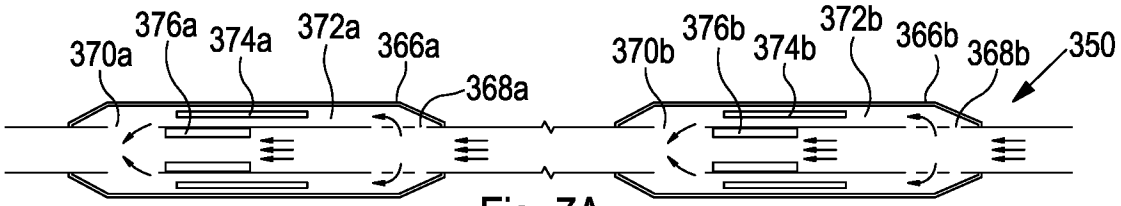
FIGS. 7A to 7D are enlarged sectional views of two tracer release apparatus of the tracer release system of FIG. 1 showing operation steps for a short tracer release apparatus shut in in a well with a normally high production rate.

FIG. 7A shows enlarged sectional views of tracer release system 350 having two tracer release apparatus 366*a* and 366*b*. Each tracer release apparatus has an inlet 368*a*, 368*b* and an outlet 370*a*, 370*b* respectively in fluid communication with a production tubing 12. Each tracer release apparatus 366*a* and 366*b* has a tracer chamber 372*a*, 372*b* which comprises a distinct tracer material 374*a*, 374*b* respectively.

The two different tracer release apparatus 366*a* and 366*b* are arranged at different locations in the well. For clarity the tracer release apparatus is arranged side by side. However, in reality the tracer release apparatus may be separated by hundreds or even thousands of metres.

The valve assemblies 376*a* and 376*b* of tracer release apparatus 366*a* and 366*b* are configured to open above a pre-set production flow rate threshold and close below the threshold level. During normal high production the flow rate is above the pre-set production flow rate threshold and therefore the valves 376*a* and 376*b* are actuated to open the outlet as shown in FIG. 7A.

Fluid passes from the production tubing 12 through inlets 368*a*, 368*b* into the fluid volume of the tracer chambers 372*a* and 372*b*. The tracer material 374*a* and 374*b* is exposed to the fluid and tracer particles are released into the fluid in each fluid volume of the tracer release apparatus 366*a* and 366*b*.

Figure 7B:
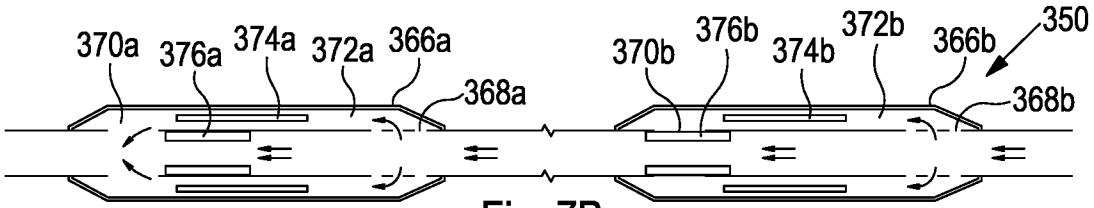

To shut in the tracer release apparatus 366*a*, 366*b* a choke assembly connected to the production tubing is adjusted to reduce the production flow from the first flow rate which is the normal production rate to a second flow rate which it lower than the pre-set threshold for the valve 376*a* and 376*b* as shown in FIG. 7B. However, as the two tracer release apparatus are at different locations in the well, they may be subject to variations in localised pressure and therefore the pressure differential required to close each valve assembly may not be the same. As a result, valve assembly 376*a* is actuated to open the outlet 370*a* whilst valve assembly 376*b* remains in a closed position despite the production flow being lower than the pre-set threshold.

Figure 7C:
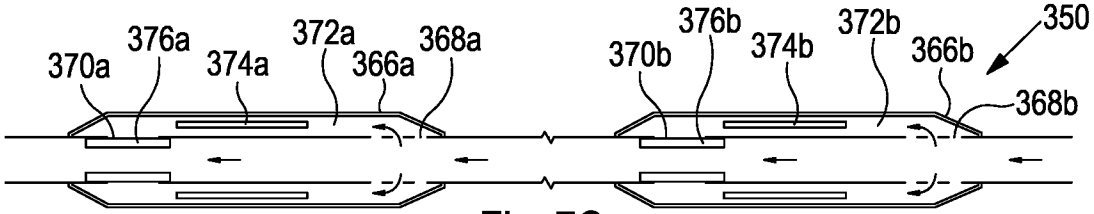

The choke assembly is adjusted to further reduce the production flow to a third flow rate. The third flow rate is lower than the first and second flow rates. At the third flow rate the pressure differential is sufficient to actuate the valve 376*b* and close outlet 370*b* as shown in FIG. 7C.

The tracer material 374*a*, 374*b* remains exposed to a volume of fluid in the tracer chamber 372*a*, 372*b* of tracer release apparatus 366*a*, 366*b* building up a high or increased concentration of the tracer molecules in the fixed fluid volume.

Figure 7D:
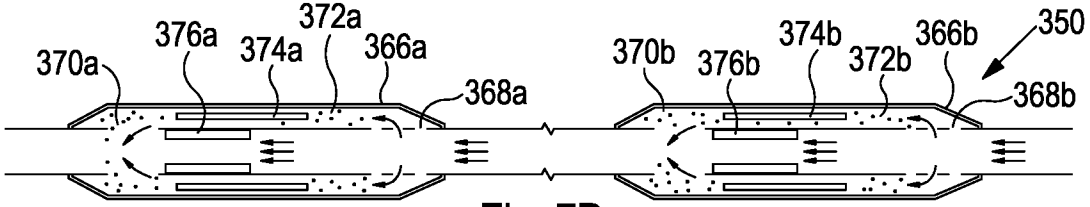

To release the tracer clouds from tracer release apparatus 366*a* and 366*b* simultaneously, the production flow choke assembly is adjusted to increase the flow rate from the third flow rate to back to the first flow rate (equivalent to the high production rate of FIG. 7A). The first flow rate is greater than the thresholds for closing valves 376*a* and 376*b* as shown in FIG. 7D.

FIG. 8A to 8D describes an inverse arrangement to FIGS. 7A to 7D for tracer release system 400. In FIGS. 8A to 8D the tracer release apparatus 416*a*, 416*b* have valve assemblies 426*a* and 426*b* respectively configured to close the outlets above a pre-set production flow rate threshold and open the outlets below the set threshold.

The valve assemblies 426*a* and 426*b* of tracer release apparatus 416*a* and 416*b* are configured to close the outlets 420*a*, 420*b* above a pre-set production flow rate threshold and open the outlet below the threshold level.

Figure 8A:
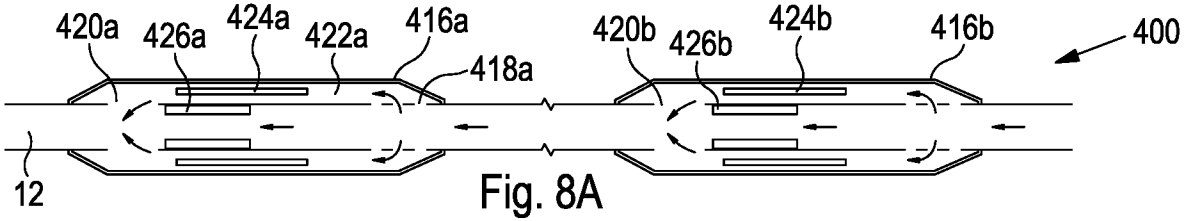
FIGS. 8A to 8D are enlarged sectional views of two tracer release apparatus of the tracer release system of FIG. 1 showing operation steps for a short tracer release apparatus shut in in a well with a normally low production rate.
Figure 8B:
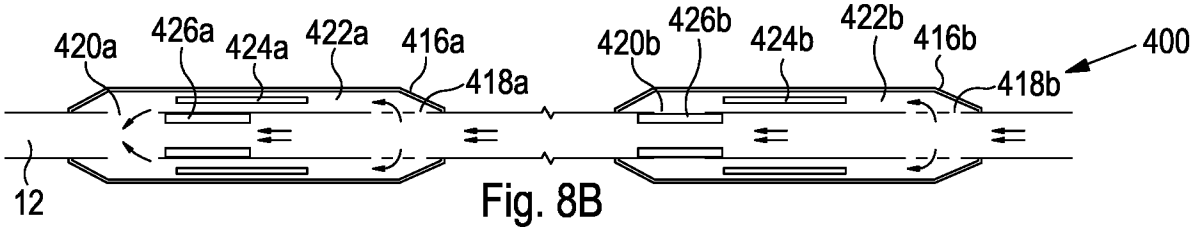

During normal low production the flow rate is below the pre-set production flow rate threshold and therefore the valve assemblies 426*a* and 426*b* open the outlets 420*a*, 420*b* as shown in FIG. 8A. Fluid passes from the production pipe through inlets 418*a*, 418*b* into the tracer chamber 422*a*, 422*b*. The tracer material is exposed to the fluid and tracer particles are released into the fluid.

In order to shut in the tracer release apparatus 416*a*, 416*b*, a choke assembly connected to the production pipe is adjusted to increase the production flow from the first flow rate which is the normal production rate to a second flow rate which it higher than the pre-set threshold for the valves 426*a* and 426*b*. However, as the two tracer release apparatus are at different locations in the well and are subject to variations in localised pressure the pressure differential required to close the valve assemblies is not the same. As a result, valve assembly 426*b* closes the outlet 420*b* whilst valve assembly 426*a* is not actuated the outlet 420*a* remains open despite the production flow being lower than the pre-set threshold.

Figure 8C:
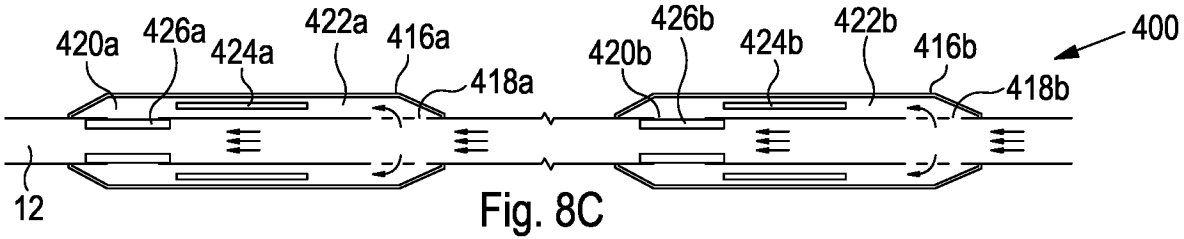

The choke assembly is adjusted to further increase the production flow to a third flow rate. The third flow rate is higher than the first and second flow rates. At the third flow rate the valve 426*a* closes the outlet 420*a* as shown in FIG. 8C. The tracer material remains exposed to a volume of fluid in the tracer chamber of tracer release apparatus 416*a*, 416*b* building up a high or increased concentration of the tracer particles in the fixed fluid volume.

Figure 8D:
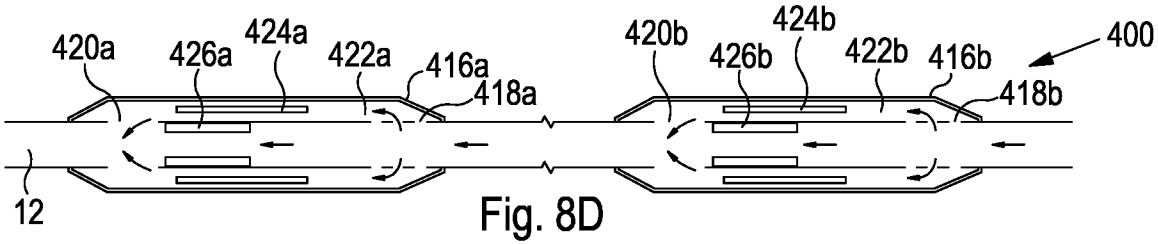

To release the built-up tracer clouds from tracer release apparatus 416*a*, 416*b* simultaneously, the choke assembly is adjusted to reduce the flow rate to a flow rate which is lower than the thresholds for opening valve assemblies 426 and 426*b*. Valve assemblies 426*a* and 426*b* are actuated to open the outlets 420*a*, 420*b* simultaneously as shown in FIG. 8D.

FIG. 9A to 9D describes a tracer release system 450 having a valve arrangement configured to open above a pre-set production flow rate threshold and close below the threshold. The valves 476*a*, 476*b* are closed during normal low production and open in temporary high production.

The valve 476*a* and 476*b* of tracer release apparatus 466*a* and 466*b* are configured to open above a pre-set production flow rate threshold and close below the threshold level. During normal low production the flow rate is below the pre-set production flow rate threshold and therefore the valve assemblies 476*a* and 476*b* remain closed as shown in FIG. 8A. Fluid passes from the production pipe through inlets 468*a*, 468*b* into the tracer chamber 472*a* and 472*b*. The tracer material is exposed to the fluid and tracer molecules are released into the fluid.

Figure 9A:
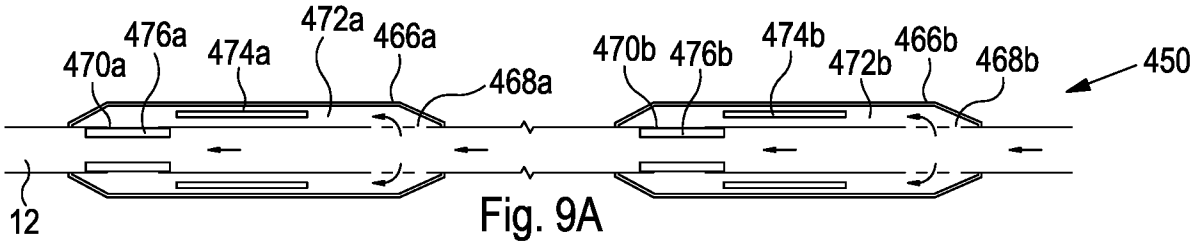
FIGS. 9A to 9D are enlarged sectional views of two tracer release apparatus of the tracer release system of FIG. 1 showing operation steps for a long tracer release apparatus shut in in a well with a normally low production rate.
Figure 9B:
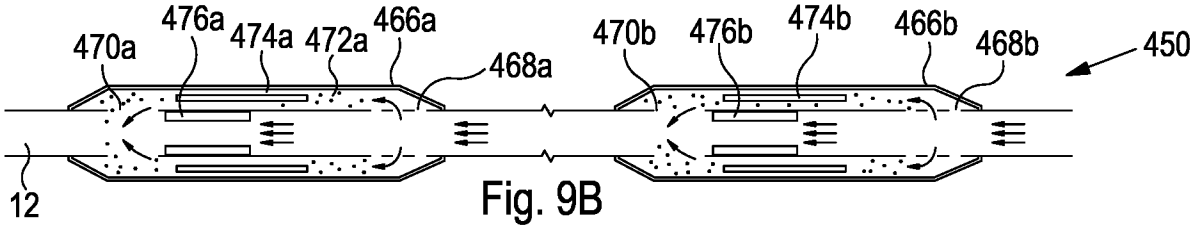

To release the fluid enriched with tracer molecules a production pipe choke assembly is adjusted to increase the production flow to a second flow rate which it significantly higher than the pre-set threshold for the valve assemblies 476*a* and 476*b*. As a result, valve assemblies 476*a*, 476*b* open simultaneously allowing the tracer clouds from tracer release apparatus 466*a*, 466*b* to be released simultaneously as shown in FIG. 9B. The tracer clouds travel to surface in the production flow and create detectable high amplitude tracer response spike signal at the detection point.

Figure 9C:
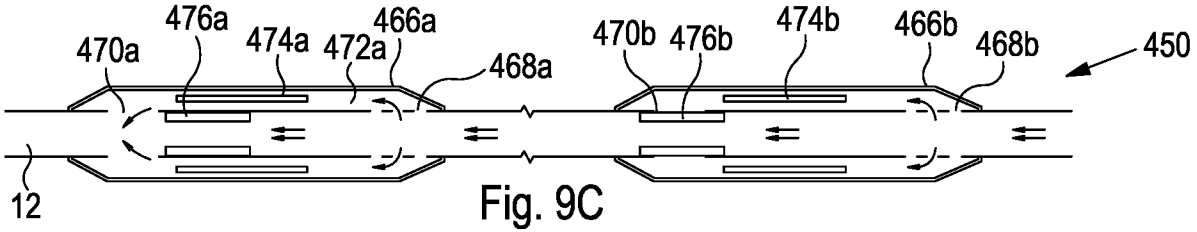

To shut in the tracer release apparatus the choke assembly is adjusted to decrease the production flow to a third flow rate. The third flow rate is higher than the first rate and lower than the second flow rate. At the third flow rate the valve assembly 476*b* closes as shown in FIG. 9C. However, as the two different tracer release apparatus are at different locations in the well, they are subject to variations in localised pressure and therefore the pressure differential required to close the valve assemblies is not the same. As a result, valve assembly 476*b* closes whilst valve assembly 476*a* remains open.

Figure 9D:
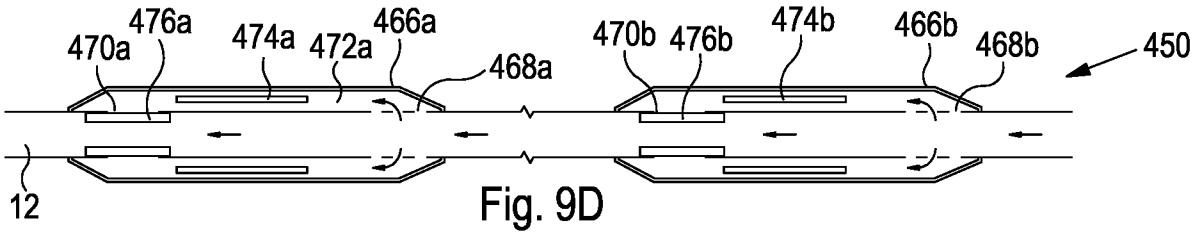

The choke assembly is adjusted to reduce the production flow back to the first flow rate. At the first flow rate the valve assembly 476*a* returned to the closed condition as shown in FIG. 9D.

FIG. 10A to 10D describes a tracer release system 500 which has an alternative valve arrangement to those described in FIG. 9A to 9D configured to close the outlets above a pre-set production flow rate threshold and open below the threshold. The valves are closed during normal high production and open in temporary low production rate.

The valve assemblies 526*a* and 526*b* of tracer release apparatus 516*a* and 516*b* are configured to open above a pre-set production flow rate threshold and close above the threshold level.

Figure 10A:
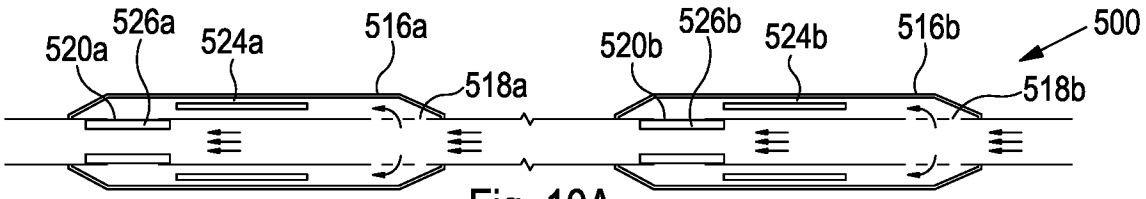
FIGS. 10A to 10D are enlarged sectional views of two tracer release apparatus of the tracer release system of FIG. 1 showing operation steps for a long tracer release apparatus shut in in a well with a normally high production rate.

During normal high production the flow rate is above the pre-set production flow rate threshold and therefore the valve assemblies 526*a* and 526*b* remain closed as shown in FIG. 10A.

Figure 10B:
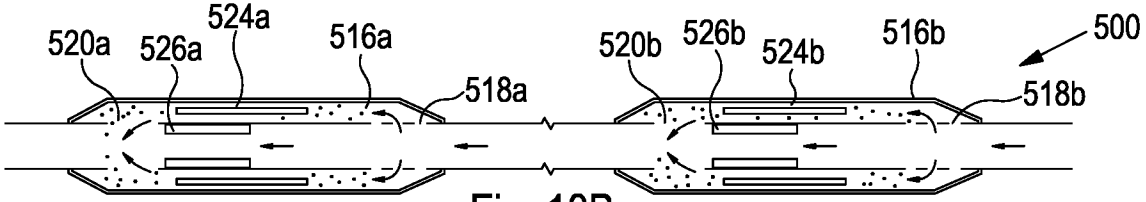

To release the tracer cloud a choke assembly connected to the production tubing is adjusted to reduce the production flow to a second flow rate which it significantly lower than the pre-set threshold for the valve assemblies 526*a* and 526*b*. As a result, valve assemblies 526*a*, 526*b* open simultaneously allowing the tracer clouds from tracer release apparatus 516*a*, 516*b* to be released simultaneously as shown in FIG. 10B. The resulting tracer clouds are detected as tracer response spike signals at the detecting point.

Figure 10C:
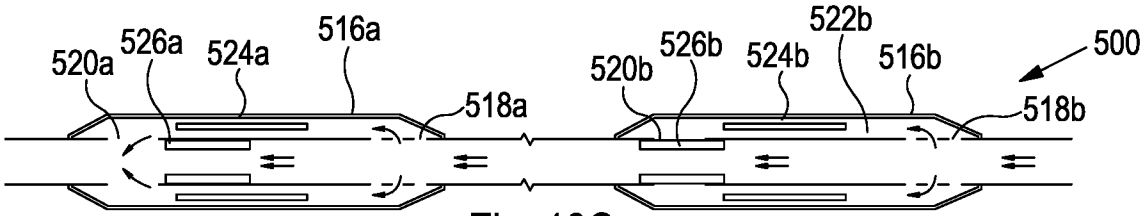
Figure 10D:
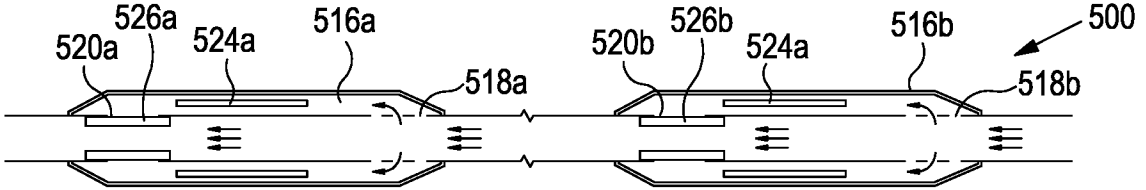

To shut in the tracer release apparatus the choke assembly is subsequently adjusted to increase the production flow to a third flow rate to close valve assembly 526*b* and outlet 520*b* as shown in FIG. 10C. Due to variations in localised pressure further adjustment of the choke is required back to the first flow rate to reach the pressure differential required to close the valve 526*a* and outlet 520*a*.

Figure 11A:
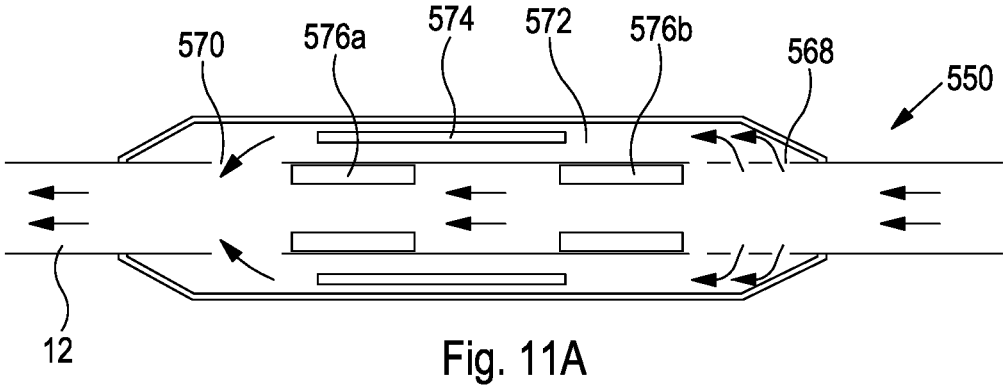
FIGS. 11A to 11C are enlarged sectional views of a tracer release apparatus with two valve assemblies in accordance with an aspect of the invention showing operation of an inlet valve and outlet valve for a short tracer release apparatus shut in in a well with a normally high production rate.

FIG. 11A shows a tracer release apparatus 550 comprising two valve assemblies 576*a*, 576*b*. In this example the valve assemblies are differential pressure valves.

The tracer release apparatus 550 has an inlet 568 and an outlet 570 in fluid communication with a production pipe 12. The tracer release apparatus has a tracer chamber 572 which comprises a tracer material 574. The tracer material may be disposed in the tracer chamber to allow fluid to pass around the tracer in the passage 572. The tracer material 574 is designed to release tracer molecules or particles when exposed to a target fluid i.e. oil, gas or water.

A first valve 576*a* is mounted for selectively opening and closing the outlet 570 to control the flow of fluid from the tracer chamber 572 to the production pipe. A second valve 576*b* is mounted for selectively opening and closing the inlet 568

In the example show in FIG. 11A the valve assembly is mounted on the outside wall of the tracer chamber 572. However, it will be appreciated that the valve assembly may be mounted on an inside wall of the tracer chamber 572.

Figure 11B:
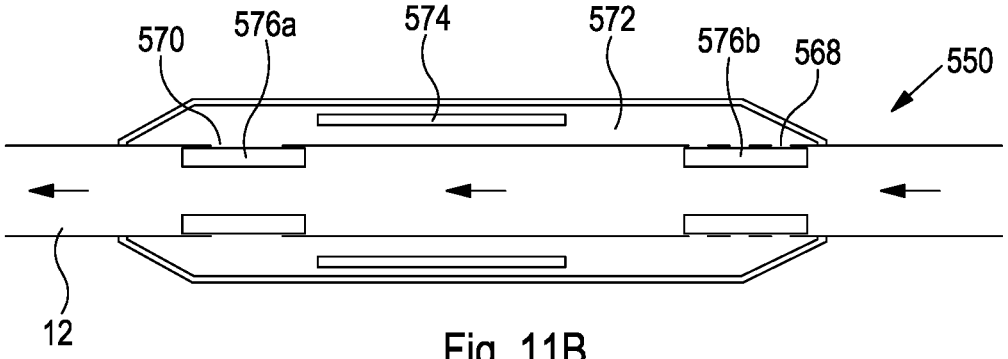
Figure 11C:
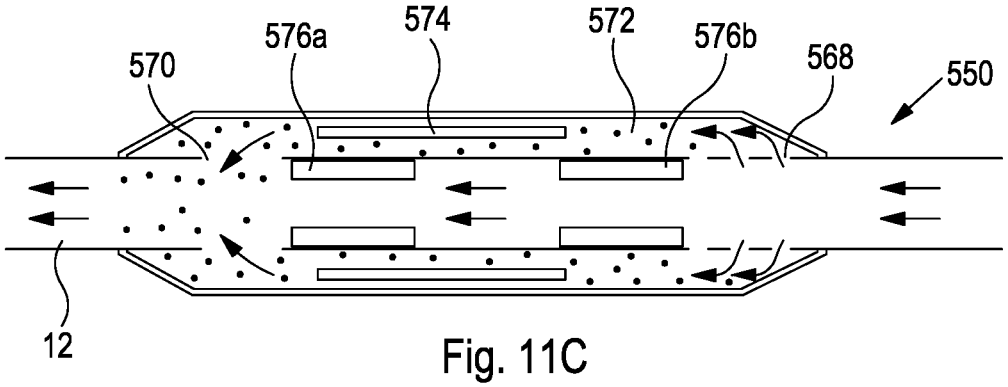

FIG. 11A to 11C show steps in the operation of two valve assemblies in the tracer release apparatus. This embodiment may prevent cross flow particularly when the fluid has high mobility such as a gas to prevent cross flow or in heterogenic reservoirs with high pressure differences between the zones in the well. The tracer release apparatus in 11A is designed to provide a short tracer release apparatus shut in to allow the concentration of tracer molecules in the fluid volume in the apparatus to increase and build up.

The valve assemblies 576*a* and 576*b* are configured to close the outlet and inlet below a pre-set production flow rate threshold and open the outlet and inlet above the threshold. During normal high production the flow rate is above the pre-set production flow rate threshold and therefore the valve assemblies 576*a* and 576*b* remain open. Fluid passes from the production pipe through inlet 568 into the tracer chamber 572. The tracer material is exposed to the fluid and tracer particles are released into the fluid. The tracer enriched fluid passes through the outlet into the production pipe and it carried by the production fluid to surface. However, as a large volume of fluid contacts the tracer the concentration of the tracer in the fluid is low.

To shut in the tracer release apparatus 550, a production tubing choke assembly is adjusted to reduce the production flow to a second flow rate which it lower than the pre-set threshold for the valve assemblies 576*a* and 576*b*. The valves 576*a* and 576*b* close the inlet 568 and outlet 570 respectively. Fluid in the tracer chamber is prevented from exiting the tracer chamber and a high concentration of tracer molecules is built up in the fixed fluid volume in the tracer chamber. The tracer chamber is sealed and the fluids surrounding the tracer material in the fluid volume of the tracer chamber becomes saturated with tracer particles.

After the shut in, to release the built-up high tracer concentration the choke assembly is adjusted to increase the production flow rate above the pre-set threshold. The valve assemblies 576*a* and 576*b* are opened which opens inlet 568 and outlet 570 respectively allowing fluid and high concentration of tracer to pass through the outlet 570 into the production tubing and fluid to enter the fluid volume of the tracer chamber via the inlet. The high or increased concentration of the tracer molecules (tracer cloud) is carried to the surface and detected as high amplitude spike signals.

Figure 12A:
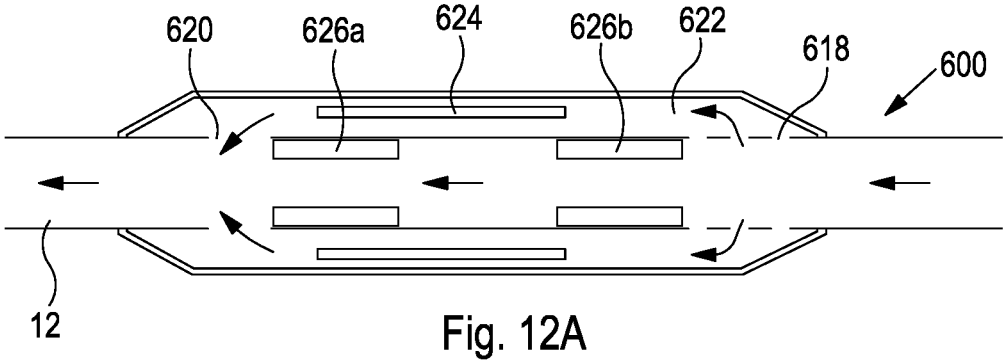
FIGS. 12A to 12C are enlarged sectional views of a tracer release apparatus with two valve assemblies in accordance with an aspect of the invention showing operation of an inlet valve and outlet valve for a short tracer release apparatus shut in in a well with a normally low production rate.
Figure 12B:
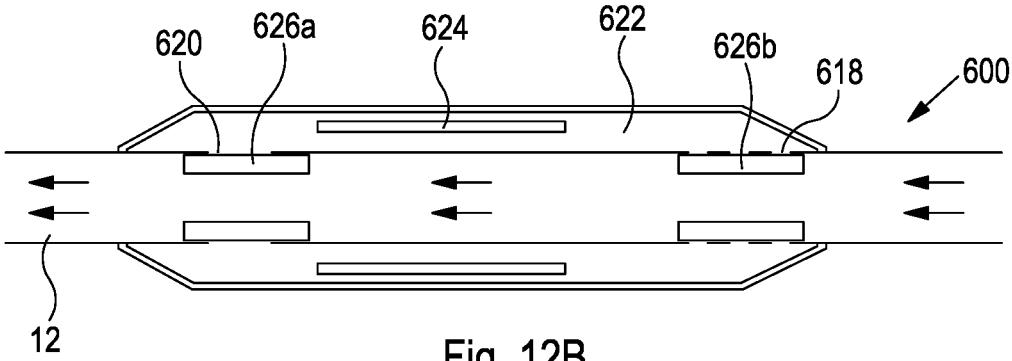
Figure 12C:
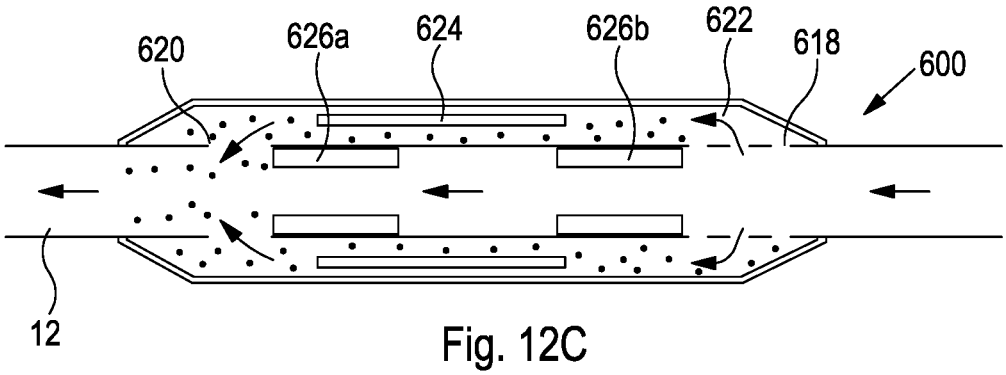

FIGS. 12A to 12C shows an alternative arrangement of the tracer release apparatus 550 of FIG. 11A and will be understood from the description of FIGS. 11A to 11C above.

However, in FIGS. 12A to 12C, the tracer release apparatus 600 is configured for use in normal low production rate well. The tracer release apparatus in FIG. 12A is designed to provide a short tracer release apparatus shut in to allow an elevated tracer molecule concentration to build up. In this example the valve assemblies are configured to close above a pre-set production flow rate threshold and open below the threshold. During normal low production the flow rate is below the pre-set production flow rate threshold and therefore the valve assemblies 626*a* and 626*b* keep the outlet 620 and inlet 618 open. However, adjusting the choke to increase the production rate above the pre-set production flow rate threshold actuates the valve assemblies 626*a* and 626*b* to close outlet 620 and inlet 618. The tracer chamber is sealed and the fluids surrounding the tracer material in the fluid volume of the tracer chamber may become saturated with tracer molecules. Reversing the choke to reduce the flow below the valve threshold actuates the valve and opens the outlet 620 and inlet 618 allowing the tracer molecules to be released as shown in FIG. 12C.

FIGS. 13A to 13C and 14A to 14C shows alternative arrangements of the tracer release apparatus of FIG. 11A and will be understood from the description of FIGS. 11A to 11C above. However, FIGS. 13A to 13C and FIGS. 14A to 14C shows tracer release apparatus designed to provide a long tracer release apparatus shut in during normal production to allow a tracer cloud to build up which is only released as required.

Figure 13A:
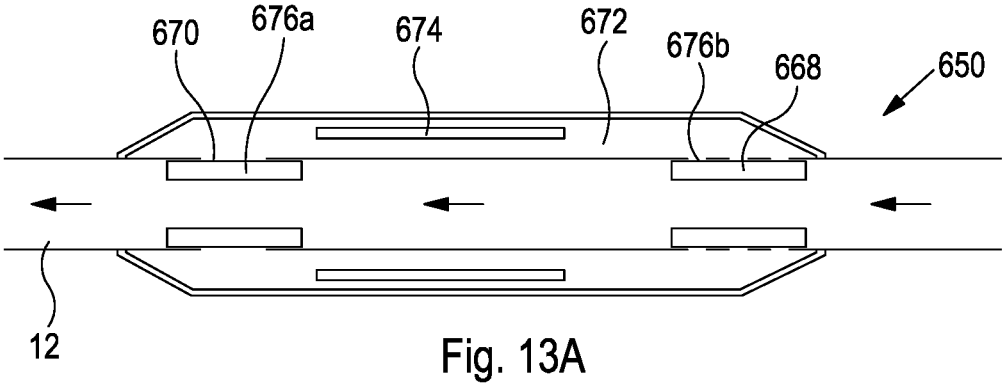
FIGS. 13A to 13C are enlarged sectional views of a tracer release apparatus with two valve assemblies in accordance with an aspect of the invention showing operation of an inlet valve and outlet valve for a long tracer release apparatus shut in in a well with a normally low production rate.
Figure 13B:
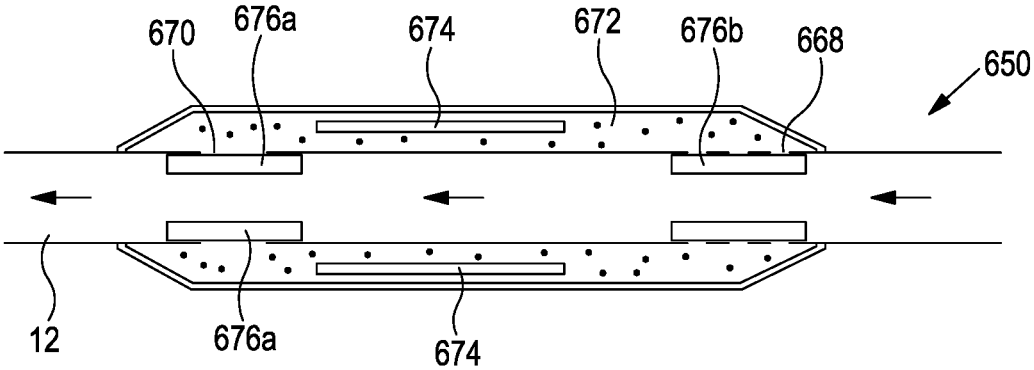
Figure 13C:
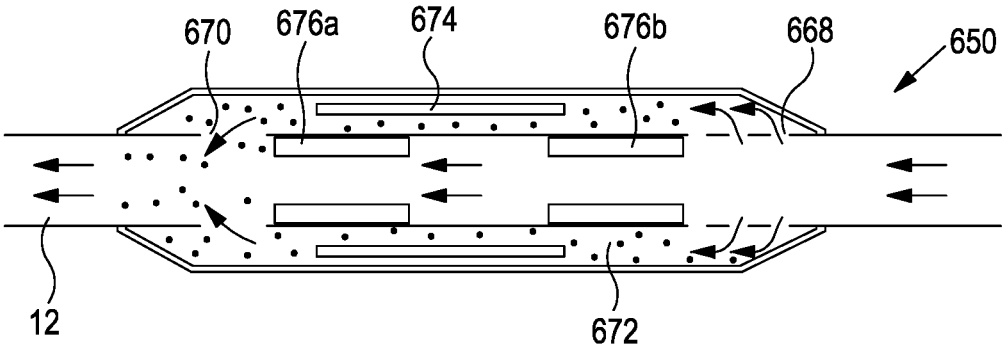

In FIG. 13A to 13C, the tracer release apparatus is designed for use in a normal low production well. The valve assemblies 676*a* and 676*b* are configured to open above a pre-set production flow rate threshold and close below the threshold. During normal low production as shown in FIG. 13A, the flow rate is below the pre-set production flow rate threshold and valve assemblies 676*a* and 676*b* close outlet 670 and inlet 668 respectively.

A volume of fluid in contact with the tracer material in the tracer chamber 672 allows a tracer cloud to build up as shown in FIG. 13B. The tracer chamber is sealed and the fluids surrounding the tracer material in the fluid volume of the tracer chamber becomes saturated with tracer molecules. The choke assembly is adjusted to temporarily increase the flow in the production pipe above the pre-set production flow rate threshold which actuates the valve assemblies 676*a* and 676*b* to open outlet 670 and inlet 668 respectively allowing the elevated concentration of tracer molecules to be flushed out of the tracer release apparatus as a tracer cloud.

Figure 14A:
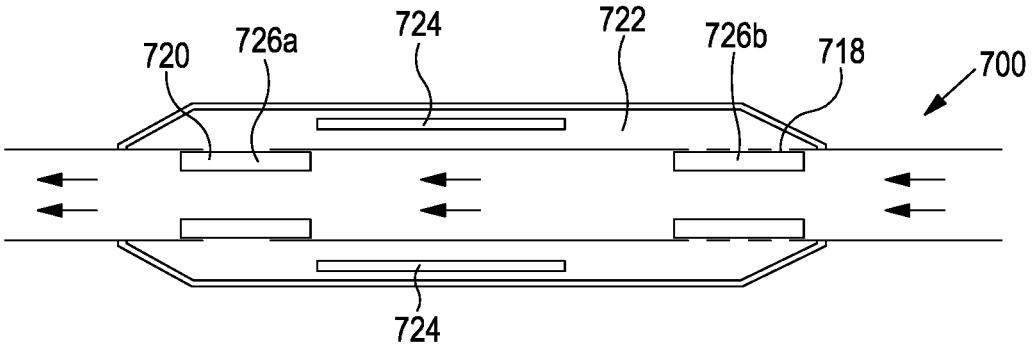
FIGS. 14A to 14C are enlarged sectional views of a tracer release apparatus with two valve assemblies in accordance with an aspect of the invention showing operation of an inlet valve and outlet valve for a long tracer release apparatus shut in in a well with a normally high production rate.
Figure 14B:
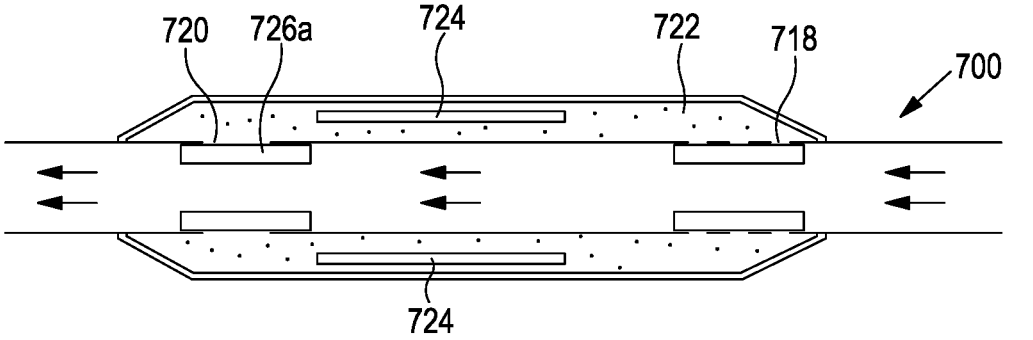
Figure 14C:
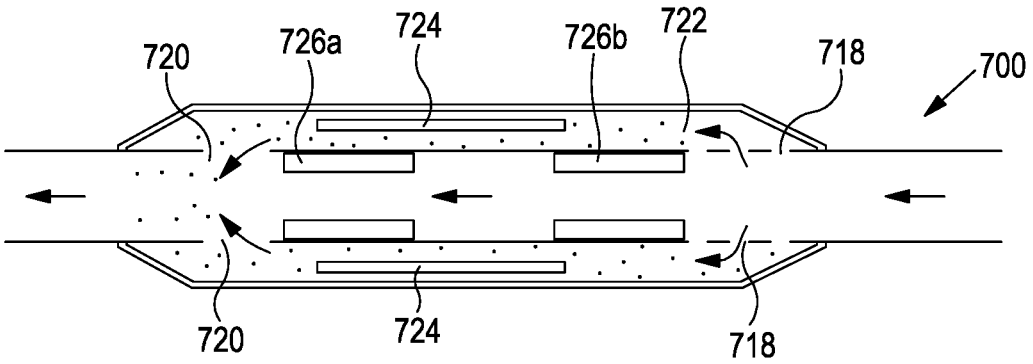

In FIG. 14A to 14C, the release apparatus 700 is designed for use in a normal high production well. The valve assemblies 726*a* and 726*b* are configured to open outlet 720 and inlet 718 respectively below a pre-set production flow rate threshold and close outlet 720 and inlet 718 respectively above the threshold.

During normal high production the flow rate is above the actuation threshold of valves 726*a* and 726*b* and therefore the valve 726*a* and 726*b* are closed. A volume of fluid in contact with the tracer material in the tracer chamber 722 allows an elevated concentration of tracer molecules and a tracer cloud to form.

To release the tracer cloud the choke assembly is adjusted to temporarily reduce the flow in the production pipe below the pre-set production flow rate threshold which actuates the valve assemblies 726*a* and 726*b* to open outlet 720 and inlet 718 respectively so that the tracer cloud to be flushed out of the tracer release apparatus.

The above examples in FIGS. 11A to 14C describe the inlet and outlet valves having the same threshold level. However, it will be appreciated that the inlet and/or outlet valve may have different actuation threshold levels or ranges. Therefore one valve may be actuated at a first production flow rate and the second valve may be actuated at a production flow rate.

Figure 15A:
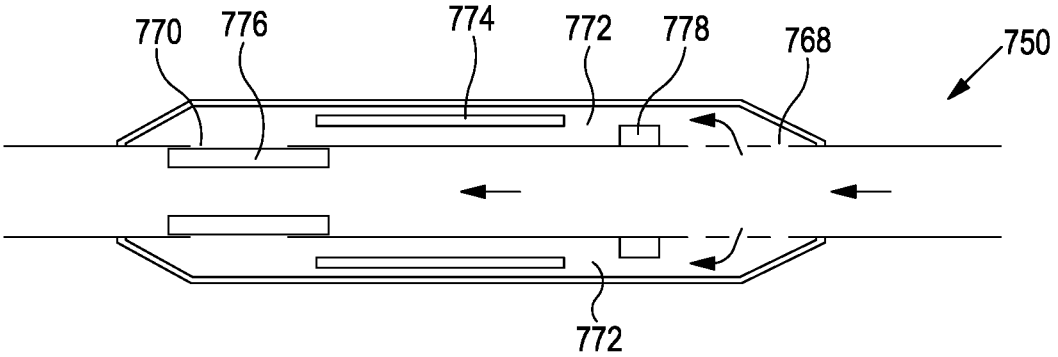
FIG. 15A to 15C are enlarged sectional views of a tracer release apparatus with flow restrictor device in the tracer release apparatus in accordance with an aspect of the invention.
Figure 15B:
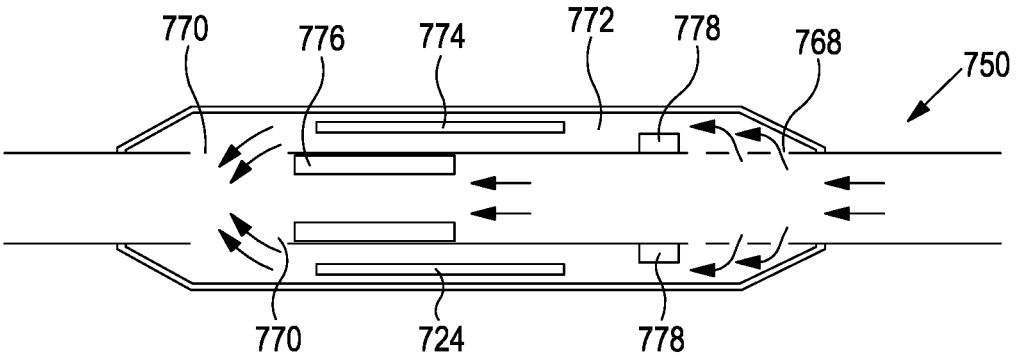
Figure 15C:
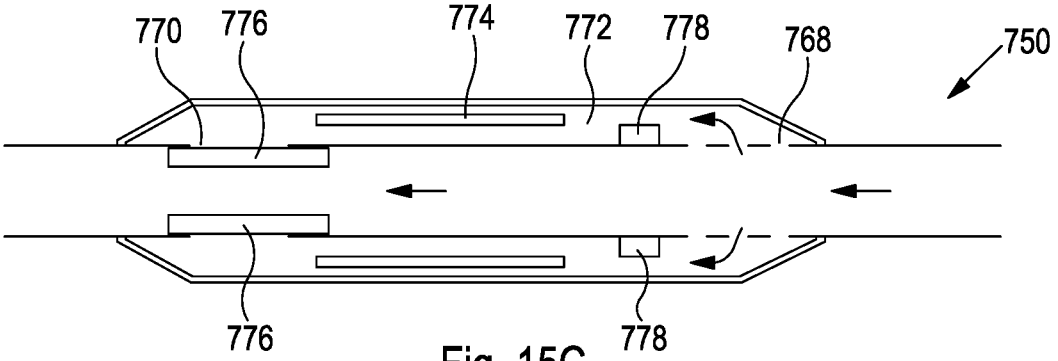

FIGS. 15A to 15C show an alternative arrangement of the tracer release apparatus 750 designed for low flow velocity well where it may be difficult to generate a differential pressure between the fluid volume of the tracer chamber and production tubing. The tracer release apparatus 750 and its method of operation is similar to the tracer release apparatus 200 described in FIG. 4A to 4C above. However, the fluid volume comprises a flow restriction device 778. The flow restriction device is located or affixed to an inner wall of the tracer release apparatus so as to extend inwardly into the fluid volume to reduce the flow area of the fluid volume. In this example the flow restriction device is a nozzle. However, it will be appreciated that other restriction device types may be used.

The nozzle 778 is arranged between the inlet 768 and the outlet 770 in the fluid volume of the tracer chamber 772. The nozzle 778 allows a pressure gradient to be created inlet 768 and the outlet 770. In low flow production wells, the choke assembly may not be capable of increasing to a rate above a pre-set production flow rate threshold. By providing the flow restrictor device in the chamber 771 of the tracer release apparatus the pressure differential is accentuated allowing actuation of the valve assembly 776.

Figure 16A:
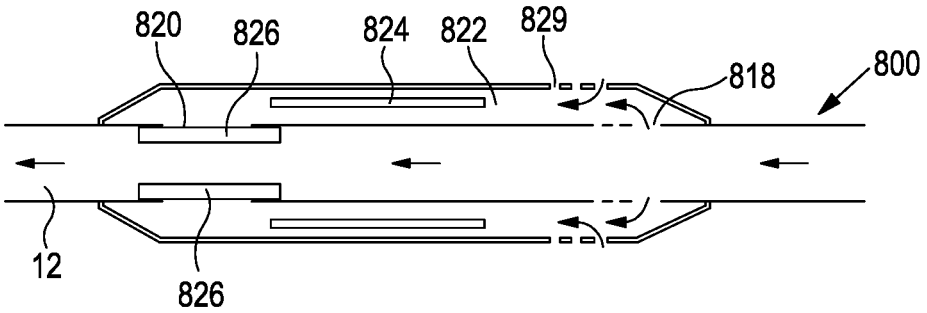
FIGS. 16A to 16C are enlarged sectional views of a tracer release apparatus with an inlet in fluid communication with the annulus in accordance with an aspect of the invention.
Figure 16B:
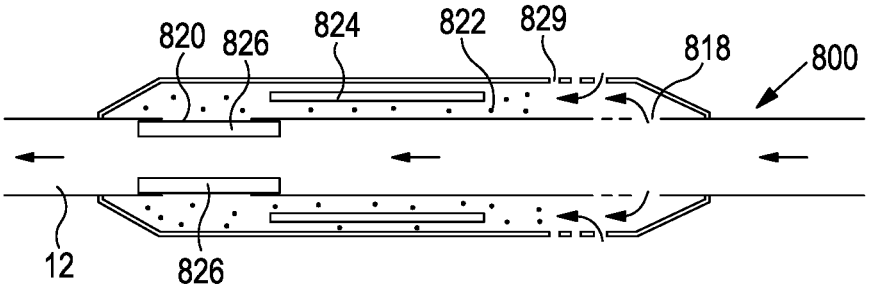
Figure 16C:
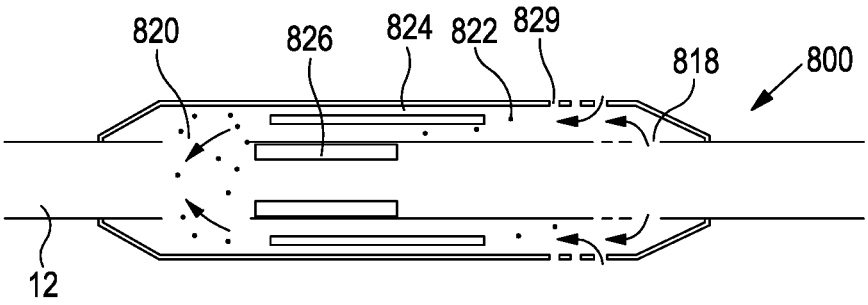

FIG. 16A to 16C shows an enlarged section of an alternate tracer release apparatus arrangement for exposing tracer material to fluid from the production tubing and the annulus. The tracer release apparatus 800 is installed on a production tubing 12. The tracer release apparatus has a first inlet 818 in fluid communication with the production tubing and a second inlet 829 in fluid communication with the annulus 11. The tracer release apparatus has an outlet 820. Arrows in FIGS. 16A to 16C denote the direction of fluid travel.

The tracer release apparatus 800 has a tracer chamber 822 which comprises a tracer material 824. The tracer material may be disposed in the tracer chamber to allow fluid to contact the tracer material and pass around the tracer material in the tracer chamber 822. The tracer material 824 is designed to release tracer molecules or particles when exposed to a target well fluid i.e. oil, gas or water.

The tracer release apparatus has a differential pressure valve 826 is mounted for selectively opening and closing the outlet 820 to control the flow of fluid from the tracer chamber 822 to the production pipe.

The valve assembly 826 is a differential pressure operated valve designed to to open and close in response to changes in differential pressure. In this case the change in differential pressure is controlled by adjusting the production flow rate. The valve assembly is set to open above a pre-set production flow rate threshold and close below the set threshold.

During normal production as shown in FIG. 16A the production flow rate is below the pre-set flow rate threshold and therefore the differential pressure valve remains open. Fluid passes from the annulus 11 through inlet 829 and from production tubing 12 through inlets 818 into the tracer chamber 822. The tracer material is exposed to the fluid and tracer particles are released into the target fluid. The tracer enriched fluid passes through the outlet into the production pipe and it carried by the production fluid to surface.

Fluid in the tracer chamber 822 is prevented from exiting the tracer chamber and allows an elevated concentration of tracer molecules to build up and a tracer cloud to form.

To open the outlet 820 the choke assembly is adjusted to increase the production flow rate above the pre-set threshold for the valve. As shown in FIG. 16C the valve assembly is opened allowing fluid and high concentration of tracer molecules to pass through the outlet 822 into the production tubing 12.

Figure 17:
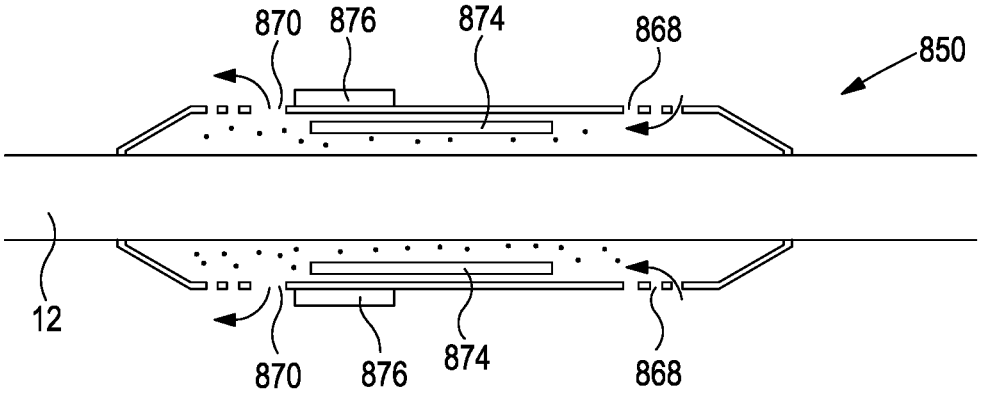
FIG. 17 is an enlarged sectional view of a tracer release apparatus with an inlet and outlet in fluid communication with the annulus in accordance with an aspect of the invention.

FIG. 17 shows an enlarged section of an alternate tracer release apparatus arrangement for exposing tracer material to fluid from the annulus and releasing the tracer cloud into the annulus. The released tracer cloud may enter the production tube at an inlet downstream of the tracer release apparatus. The tracer release apparatus 850 is installed on a production tubing 12. The tracer release apparatus has an inlet 868 in fluid communication with the annulus 11 and an outlet 870 in fluid communication with the annulus 11. Arrows in FIG. 17 denote the direction of fluid travel.

The tracer release apparatus 850 has a tracer chamber 872 which comprises a tracer material 874. The tracer material may be mounted in the tracer chamber to allow fluid to contact the tracer material and pass around the tracer material in the tracer chamber 872. The tracer material 874 is designed to release tracer molecules or particles when exposed to a target well fluid i.e. oil, gas or water.

A valve assembly 876 is designed to open and close the outlet in response to changes in differential pressure in fluid flow. In the example shown in FIG. 17, the valve assembly is mounted on an outside wall of the tracer chamber. However, it will be appreciated that the valve assembly may be mounted on an inside wall of the tracer chamber.

The valve assemblies described above are configured to open or close when the valve is exposed to a differential pressure which reaches a predetermined level. For example, when a differential pressure created by a change in production flow results in a traveling sleeve moving to a closed position.

When the valve is opened the built up tracer cloud is released into the annulus where it may enter the production tubing at an influx point further downstream where it travels to surface.

FIGS. 18A to 21B show different example valve assemblies that may be used in the tracer release assemblies described in FIGS. 1 to 17 and 23. The velocity valve assembly or a differential pressure valve assembly described below may be used to permit, choke or prevent flow into and/or out from the tracer release apparatus.

Figure 18B:
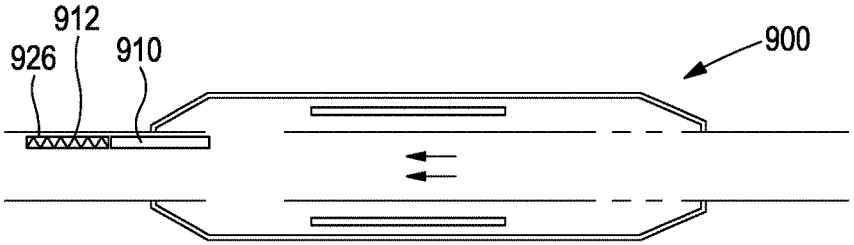
FIGS. 18A and 18B are schematic diagrams of components of a velocity valve assembly for use in a tracer release apparatus in accordance with an aspect of the invention.
Figure 18A:
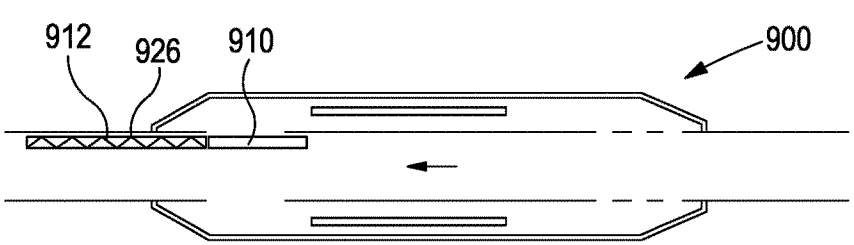

FIG. 18A shows a tracer release apparatus 900 with a velocity valve assembly 926. The velocity valve is located in the inner diameter of the production tubing. The velocity valve has an actuating sleeve 910 which is biased in FIG. 18A to a closed position by a spring 912. The valve actuating sleeve 910 is designed to move in a linear movement between valve closed position and open position shown in FIGS. 18A and 18B respectively. In a first valve arrangement shown in FIG. 18A the spring 912 is a compression spring biased in a fully closed position in a low production flow. In response to a high production flow rate, the flow acting on the sleeve 910 is sufficient to compress the spring 912 moving the sleeve 910 to a fully open position. In a low production flow condition, the force acting on the sleeve 910 by the production flow is not sufficient to overcome the spring force of spring 912. The spring expands and moves the sleeve to a fully closed position as in FIG. 18B.

Figure 19B:
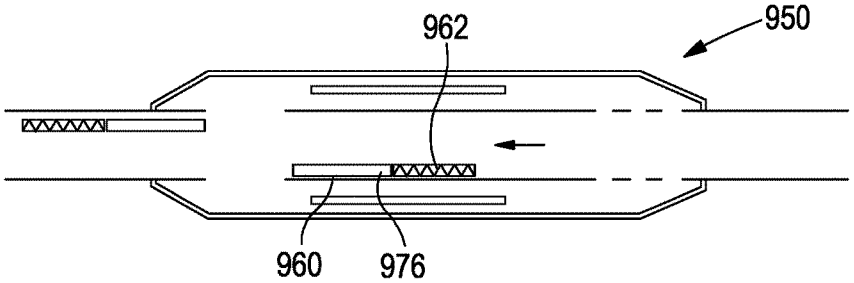
FIGS. 19A and 19B are schematic diagrams of components of a velocity valve assembly for use in a tracer release apparatus in accordance with a further aspect of the invention.
Figure 19A:
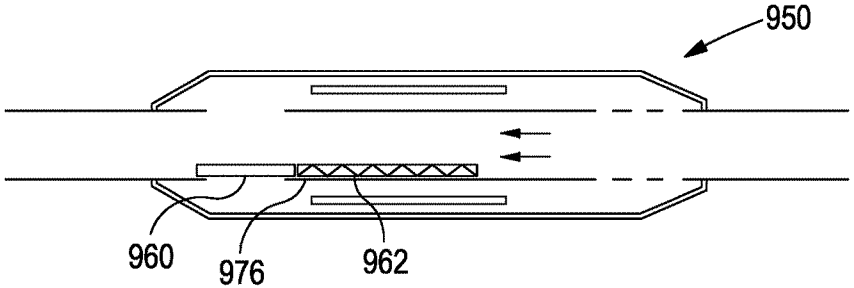

FIG. 19A shows a tracer release apparatus 950 with a velocity valve assembly 976. The spring 962 is a tension spring biased towards an open position. In response to a high production flow rate, such as during normal production, the flow acting on sleeve 960 is sufficient to overcome the spring force of spring 962. The spring is expanded moving the sleeve 960 to a closed position. In a low production flow condition, the force acting on the sleeve 962 by the production flow is not sufficient to overcome the spring force. The spring retracts and moves the sleeve to an open position as shown in FIG. 19B.

Although FIGS. 18A, 18B, 19A and 19B show the sleeve movable between fully open and fully closed positions. It will be appreciated that the sleeve may be located at intermediate positions between the fully opened and fully closed. The sleeve may be set to be partially opened and partially closed depending on the production flow rate in order to throttle or choke flow through the valve.

Figure 20B:
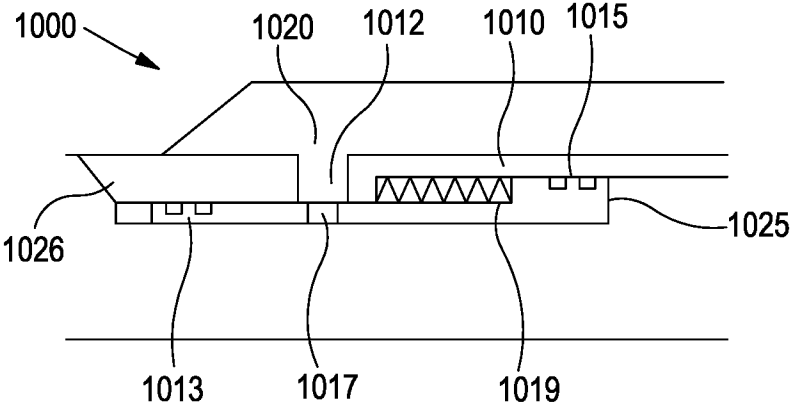
FIGS. 20A and 20B are schematic diagrams of components of a velocity pressure valve assembly for use in a tracer release apparatus in accordance with an aspect of the invention.
Figure 20A:
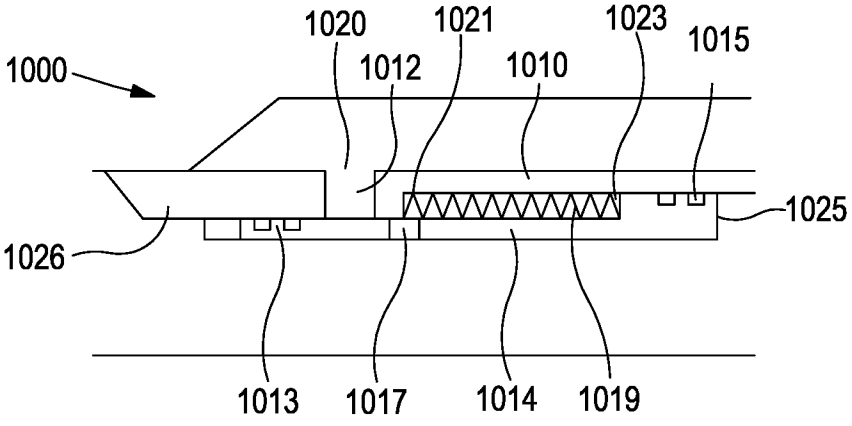

FIGS. 20A and 20B shows an enlarged view of a velocity pressure operated valve assembly 1026 in a tracer release apparatus 1000. The other components of the apparatus have been removed for clarity. The valve assembly has a valve body 1010 having a port 1012 through the wall of the valve body which is aligned with the outlet 1020 of the tracer release apparatus. A sleeve 1014 supported by the valve body with seals 1013 and 1015 at each end. The sleeve is axially movable relative to the valve body. The sleeve 1014 has a port 1017. The sleeve is movable from a closed position where the sleeve port 1017 is not aligned with port 1012 and outlet 1020 as shown in FIG. 20A, to an open position where the sleeve port 1017 is aligned with port 1012 and outlet 1020 as shown in FIG. 20B.

A sleeve biasing mechanism, in this case a spring 1019 is located between a shoulder 1021 on the valve body and shoulder 1023 on the sleeve.

In this example the sleeve biasing mechanism is a spring 1021 it will be appreciated that other biasing mechanisms may be used such as a pressure chamber containing a gas such as nitrogen The sleeve 1014 acts as a piston which is axially movable by production flow is applied to sleeve 1014 via shoulder 1025 of the sleeve. When the flow applied to shoulder 1025 reaches a predetermined amount the flow force compresses spring 1014 to axially move the sleeve such that the sleeve port 1017 is brought into alignment with port 1012 and outlet 1020.

The sleeve will remain in the open position as shown in FIG. 20B as long as the force of the production flow is sufficient to keep the spring 1014 compressed.

Once the flow rate of the production flow is reduced below a predetermined amount the force of the spring can overcome the pressure force acting on the via shoulder 1025 of the sleeve. The sleeve is moved to a closed position where the sleeve port 1017 is not in alignment with port 1012 and outlet 1020.

The force acting on the sleeve can be adjusted by reducing or increasing flow rate in the production tubing by controlling a choke connected to the production tubing. In this example the spring in a compression spring. However, it will appreciate that a tension spring may be used.

Figure 21A:
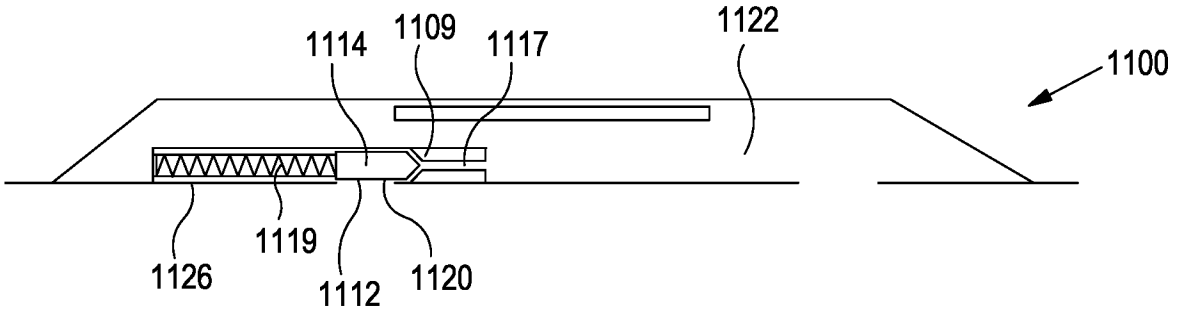
FIGS. 21A and 21B are schematic diagrams of components of a differential pressure valve assembly for use in a tracer release apparatus in accordance with a further aspect of the invention.
Figure 21B:
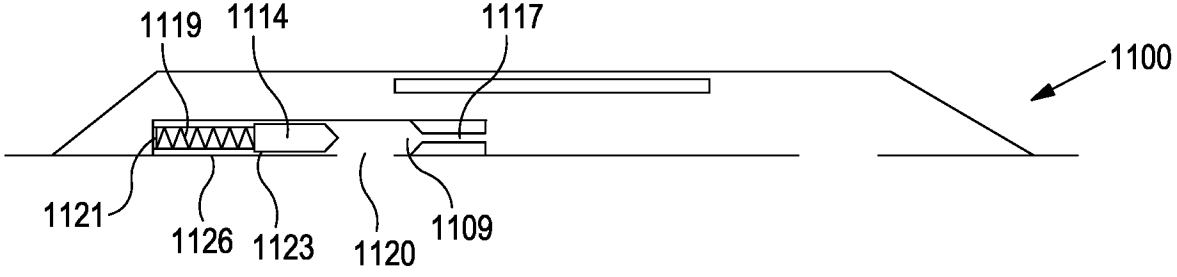

FIGS. 21A and 21B shows an enlarged view of differential pressure operated valve assembly 1126 in a tracer release apparatus 1100. The valve assembly 1126 is located within the tracer release apparatus to avoid restriction of the inner diameter of the production tubing. The other components of the apparatus have been removed for clarity.

The valve assembly 1126 has a valve body 1110 having an outlet port 1112 through the wall of the valve body which is aligned with the outlet 1120 of the tracer release apparatus. A sleeve 1114 is axially movable relative to the valve body. The valve body 1110 has an inlet port 1117 in fluid communication with a valve seat 1119. In a valve closed position the sleeve is located in the valve seat 1109 and the sleeve covers outlet port 1112 and outlet 1120 as shown in FIG. 21A. In a valve open position, the sleeve is moved axially away from the valve seat and the outlet port 1112 and outlet 1120 are in fluid communication with the inner volume within the tracer release apparatus as shown in FIG. 21B.

A sleeve biasing mechanism, in this case a spring 1119 is located between shoulder 1121 on the valve body and shoulder 1123 on the sleeve.

In this example the sleeve biasing mechanism is a spring 1121 it will be appreciated that other biasing mechanisms may be used such as a pressure chamber containing a gas such as nitrogen.

The sleeve 1114 acts as a piston which is axially movable by differential in pressure between the tracer release apparatus and the production tubing. Pressure from the tracer release apparatus is applied to sleeve 1114 via inlet port 1117. Pressure from the production tubing is applied to sleeve 1114 via outlet port 1112 and outlet 1120. When a pressure applied to inlet port 1117 reaches a predetermined amount the pressure force compresses spring 1114 to axially move the sleeve away from valve seat 1109 such that the sleeve uncovers outlet port 1112 and outlet 1120.

The sleeve will remain in the open position as shown in FIG. 21B as long as the differential pressure between the tracer release apparatus and the production tubing is sufficient to keep the spring 1114 compressed.

Once the pressure differential between the tracer release apparatus and the production tubing is reduced below a predetermined amount the force of the spring can overcome the pressure force acting on the sleeve. The sleeve is moved to a closed position where the sleeve is in the valve seat 1109.

The pressures on acting on the sleeve can be adjusted by reducing or increasing pressure in the production tubing by controlling a choke connected to the production tubing. In this example the spring in a compression spring. However, it will appreciate that a tension spring may be used.

Although the above examples described in FIGS. 18A to 21B the valves are described as normally closed it will be appreciated that the valves may be set to be normally open and move to a closed position in response to a change in flow velocity and/or a change in differential pressure.

Figure 22C:
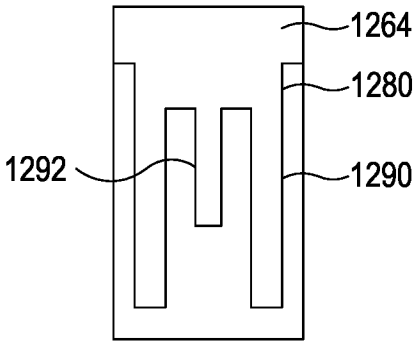
FIGS. 22A, 22B and 22C are schematic diagrams of components of a control mechanism for use in a tracer release apparatus in accordance with an aspect of the invention.
Figure 22B:
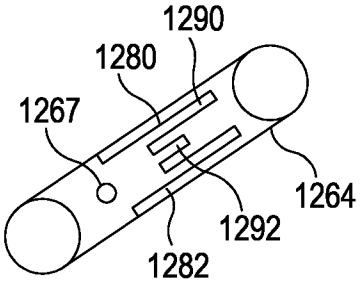
Figure 22A:
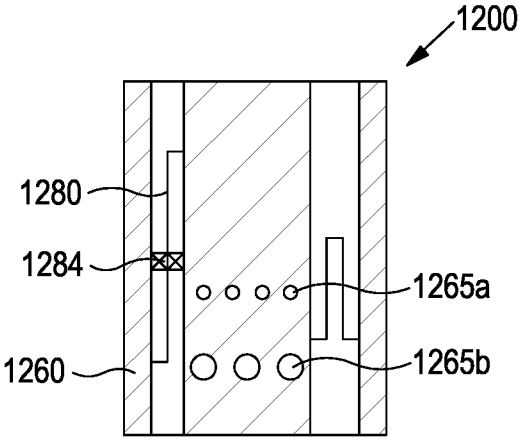

FIG. 22A shows a valve control mechanism 1200 for controlling the actuation of the valve. In this example the valve is a sleeve valve.

The control mechanism 1200 has a sleeve 1264 with a keyway 1280 best shown in FIG. 22B. The keyway 1280 comprises a plurality of axial slots or tracks 1282 formed around the outer surface of sleeve. A stationary indexer pin 1284 mounted on the valve body 1260 is located between the sleeve and the valve body and is configured to move within the keyway. The sleeve has a sleeve port 1267 which is configured to be aligned with the outlet of the tracer releaser apparatus when in an open valve position. The sleeve port 1267 is configured to be covered when in a closed valve position.

Axial movement of the sleeve 1264 in response to a fluid velocity change such as described in FIGS. 18A, 18B, 19A, 19B, 20A and 20B and or in response to a change in differential pressure such as described in FIGS. 21A and 21B results in the indexer pin 1284 moving in the keyway 1280.

Depending on the design of the keyway 1280 the sleeve 1264 is prevented from being moved to an open position until a selected number of fluid pressure or fluid velocity cycles have been applied to sleeve. Alternatively, the sleeve 1264 is prevented from being moved to a closed position until a selected number of fluid pressure or fluid velocity cycles have been applied to sleeve.

As the indexer pin 1284 is cycled through the keyway 1280, the sleeve 1264 is moved to actuate the valve between a closed or open position. The tracks 1282 in the keyway having different lengths and are used to control the actuation of the valve.

In the example shown in FIGS. 22B and 22C, the keyway 1280 has alternate long tracks 1290 and short tracks 1292 arranged around the periphery of the sleeve. When the indexer pin is located within the long track 1290 the valve is in the open position and the sleeve port is aligned with outlet of the tracer release apparatus. Movement of the sleeve in response to a flow velocity or differential pressure moves the sleeve into the short track. When the pin is located in the short track 1292 the sleeve moves to a position in which the sleeve port is not aligned with outlet of the tracer release apparatus. Further movement of the sleeve in response to a flow velocity or differential pressure moves the sleeve but if the indexer pin is still within the short track so the valve remains in the closed position.

A further embodiment of the valve control mechanism 1250 is that the sleeve may have different sizes of sleeve ports 1265*a*, 1265*b* as best shown in FIG. 22A. Each port size may correspond with different axial tracks 1282 in the keyway 1280. For example, when the index pin 1284 is in a first track the sleeve ports 1265*a*, 1265*b* may be blocked and the valve is closed. When the index pin 1284 is a second track the sleeve is moved to align a small sleeve port or series of small ports 1265*a* with the tracer releasing outlet thereby releasing the tracer gradually from the apparatus through the small sleeve port. However, when the index pin 1284 is located in a third track the sleeve is moved to align a larger sleeve port or series of larger ports 1265*b* with the outlet of the tracer releasing apparatus thereby releasing the tracer quickly from the apparatus through the large sleeve port.

Another feature of the valve control mechanism may be set such that the sleeve port may located at intermediate positions between fully opened and fully closed corresponding to different axial tracks in the keyway. This allow for the controlled opening, closing, partially opening or partially closing of the valve.

Although the above examples describe the control mechanism being used to control the actuation of a valve to open and close an outlet on the tracer release apparatus, it will be appreciated that the control mechanism being used to alternatively or additionally control the actuation of a valve to open and close an inlet on the tracer release apparatus. In the above examples the valve is a sleeve valve. However, it will be appreciated that other valve types may be used.

Figure 23A:
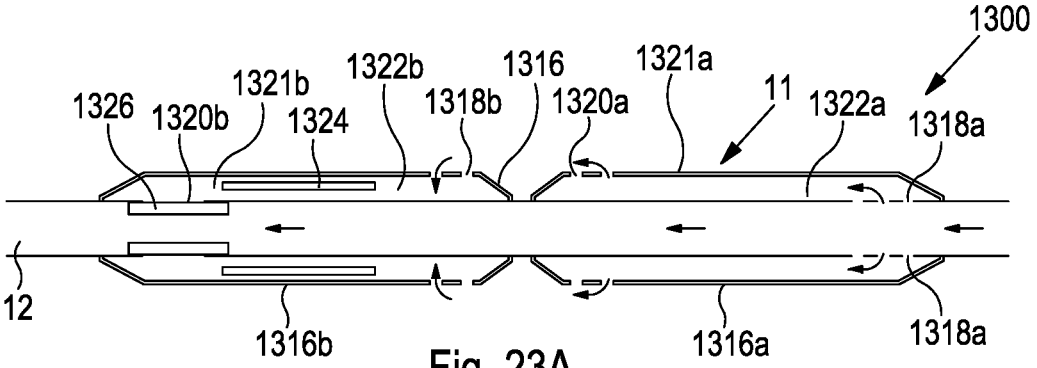
FIGS. 23A, 23B and 23C are enlarged sectional views of a tracer release apparatus with an outward venting section in fluid communication with the production tubing according to an embodiment of the invention showing operation steps for a long tracer release apparatus shut in in a well with a normally low production rate.
Figure 23B:
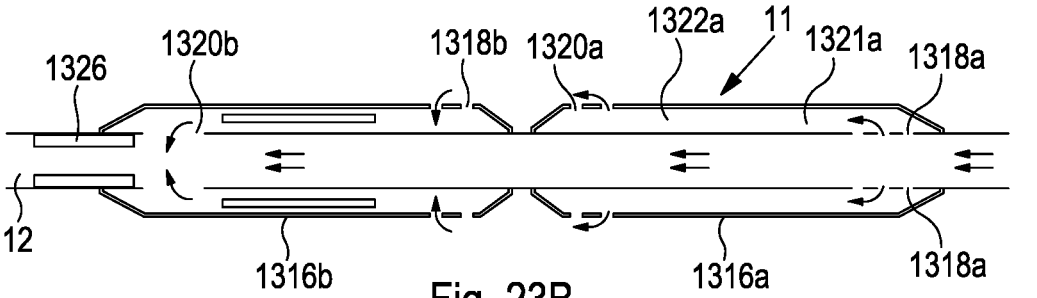
Figure 23C:
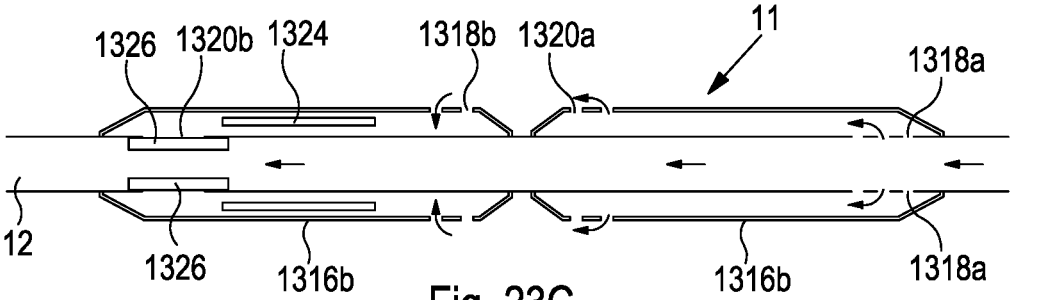

FIGS. 23A to 23C show enlarged sections of a tracer release apparatus 1300. The tracer release apparatus is installed on a production tubing 12. The tracer release apparatus 1316 has an outward venting section 1316*a* with an inlet 1318*a* in fluid communication with the production tubing and an outlet 1320*a* in fluid communication with annulus 11. The outward venting section 1316*a* has an annulus chamber 1321*a* surrounding the production tubing with a fluid volume 1322*a* between inlet 1318*a* and outlet 1320*a*.

The tracer release apparatus 1300 has an inward venting section 1316*b* with an inlet 1318*b* in fluid communication with the annulus 11 and an outlet 1320*b* in fluid communication with a production pipe 12. Arrows in FIGS. 23A to 23C denote the direction of fluid travel. The inward venting section 1316*b* has an annulus tracer chamber 1321*b* surrounding the production tubing with a fluid volume 1322*b* which comprises a tracer material 1324. The tracer material may be disposed in the tracer chamber to allow fluid to contact the tracer material and pass around the tracer material in the fluid volume 1322*b*. The tracer material 1324 is designed to release tracer molecules or particles when exposed to a target well fluid i.e. oil, gas or water.

A valve assembly 1326 is fixed with a movably closure member for selectively opening and closing the outlet aperture 1320*b* to control the flow of fluid from the tracer chamber 1321*b* to the production pipe.

In this example the valve assembly 1326 is a differential pressure operated valve designed to open and close in response to changes in differential pressure between the production tubing and the tracer release apparatus. In this case the change in differential pressure is controlled by adjusting the production flow rate. The valve assembly is set to open above a pre-set production flow rate threshold and close below the set threshold.

During normal production as shown in FIG. 23A the production flow rate is below the pre-set flow rate threshold and therefore the valve assembly remains closed. Fluid passes from the production pipe through inlet 1318*a* into the fluid volume 1322*a* of the annulus chamber 1321*a* and through outlet 1320*a* of the outward venting section 1316*a* into the annulus 11. Fluid enters the fluid volume 1322*b* of the inward venting section 1316*b* from the annulus 11 via inlet 1318*b*.

In fluid volume 1322*b* the tracer material is exposed to the target fluid and tracer particles are released into the fluid. Tracer material 1324 in the fluid volume remains exposed to a volume of fluid in the fluid volume 1322 over the period of time that the valve 1326 is closed, building up a high concentration of the tracer particles in the inner fluid volume of the tracer release apparatus.

When a tracer release operation is required, the choke assembly is temporarily adjusted to increase the production flow rate to a second flow velocity which it higher than the pre-set threshold for the valve 1326, the valve 1326 opens the outlet 1320*b* releasing the fluid and high concentration tracer cloud into the production tubing 12. Fluid flow via the deviated path of inlet 1318*a* outlet 1320*a* of the outward venting section and via inlet 1318*b* gradually flushes out the high or increased concentration of the tracer molecules from the fluid volume of the tracer chamber into the production tubing as a tracer cloud. The released tracer cloud creates a high amplitude spike signal at a detection point followed by a decay curve of tracer signal which represents the gradually displacement and flush out of the tracer from the tracer release apparatus.

Figure 24A:
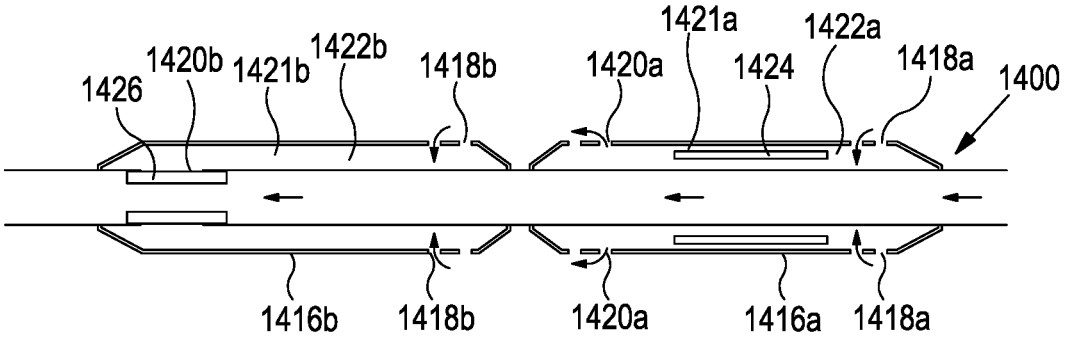
FIGS. 24A, 24B and 24C are enlarged sectional views of a tracer release apparatus with an outward venting section in fluid communication with the annulus according to an embodiment of the invention showing operation steps for a long tracer release apparatus shut in in a well with a normally low production rate.
Figure 24B:
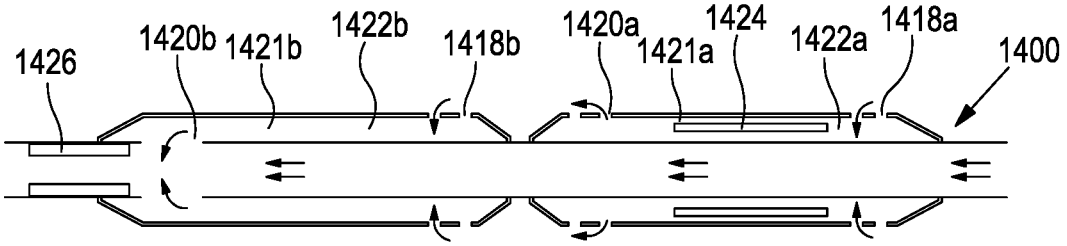
Figure 24C:
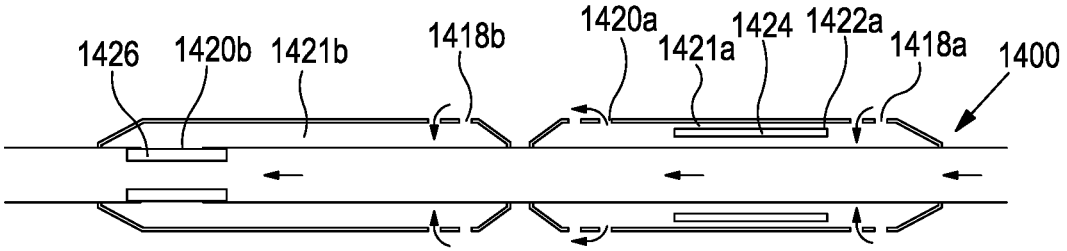

FIG. 24A to 24C are enlarged sections of a tracer release apparatus 1400. The tracer release apparatus is installed on a production tubing 12. The tracer release apparatus 1416 has an outward venting section 1416*a* with inlets 1418*a* and outlets 1420*a* in fluid communication with annulus 11. The outward venting section 1416*a* has an annulus tracer chamber 1421*a* surrounding the production tubing with a fluid volume 1422*a* which comprises a tracer material 1424. The tracer material is disposed in the tracer chamber to allow fluid to contact the tracer material and pass around the tracer material in the fluid volume 1422*a*. The tracer material 1424 is designed to release tracer molecules when exposed to a target well fluid i.e. oil, gas or water.

The tracer release apparatus 1400 has an inward venting section 1416*b* with inlets 1418*b* in fluid communication with the annulus 11 and outlets 1420*b* in fluid communication with a production pipe 12. Arrows in FIGS. 24A to 24C denote the direction of fluid travel. The inward venting section 1416*b* has an annulus chamber 1421*b* surrounding the production tubing with a fluid volume 1422*b* between inlet 1418*b* and outlet 1420*b*.

A valve assembly 1426 is fixed with a movably closure member for selectively opening and closing the outlet apertures 1420*b* to control the flow of fluid from the annulus chamber 1421*b* to the production pipe.

In this example the valve assembly 1426 is a differential pressure operated valve designed to open and close in response to changes in differential pressure between the production tubing and the tracer release apparatus. In this case the change in differential pressure is controlled by adjusting the production flow rate. The valve assembly is set to open above a pre-set production flow rate threshold and close below the set threshold.

During normal production as shown in FIG. 24A the production flow rate is below the pre-set flow rate threshold and therefore the valve assembly remains closed. Fluid passes from the annulus through inlet 1418*a* into the fluid volume 1422*a* of the annulus tracer chamber 1421*a* and through outlet 1420*a* of the outward venting section 1416*a* into the annulus 11.

In the fluid volume 1422*a* the tracer material is exposed to the target fluid and tracer molecules are released into the fluid.

Fluid enters the fluid volume 1422*b* of the inward venting section 1416*b* from the annulus 11 via inlet 1418*b*. The fluid with tracer molecules is prevented from entering the production tubing while the valve 1426 is closed.

When a tracer release operation is required, the choke assembly is temporarily adjusted to increase the production flow rate to a second flow velocity which it higher than the pre-set threshold for the valve 1426, the valve 1426 opens the outlet 1420*b* releasing the fluid and tracer molecules into the production tubing 12. The tracer enriched fluid is gradually flushed out of the fluid volume 1422*b* into the production tubing.

The released tracer creates a high amplitude spike signal at a detection point followed by a decay curve of tracer signal which represents the gradually displacement and flush out of the tracer from the tracer release apparatus.

In the above example tracer material is disposed in the annulus chamber 1421*a* of the outward venting section 1416*a*. However, it will be appreciated that tracer material may be alternatively or additionally may be disposed in the annulus chamber 1421*a* in the inward venting section 1416*b*. In examples where tracer material is disposed in the outward venting section 1416*a* and inward venting section 1416*b* the tracer material in the inward venting section may be same or different to the tracer material in the outward venting section.

In the above examples described in FIGS. 23A to 24C the tracer release apparatus is configured to shut in the tracer release apparatus during normal low production and release the high or increased concentration of tracer by temporarily increasing the production flow rate. However it will be appreciated that the tracer release apparatus may alternatively be configured to shut in during normal high production in high production wells and release the tracer by temporarily decreasing the production flow rate.

It will also be appreciated the tracer release apparatus may be configured to allow release of tracer during normal production flow and to be temporarily shut in by adjusting the flow production flow rate.

It will be further appreciated that although the above examples described in FIGS. 23A to 24C have a valve disposed at the outlet 1420*b* of the tracer release operation, it will be understood from the above examples that valves may be positioned at any and/or all of the inlets and/or outlets of the tracer release apparatus. For examples valve assemblies may control the flow of fluid through outlets 1420*a* and/or 1420*b*. Alternatively or additionally valve assemblies may control the flow of fluid through inlets 1418*a* and/or 1418*b*.

Figure 25A:
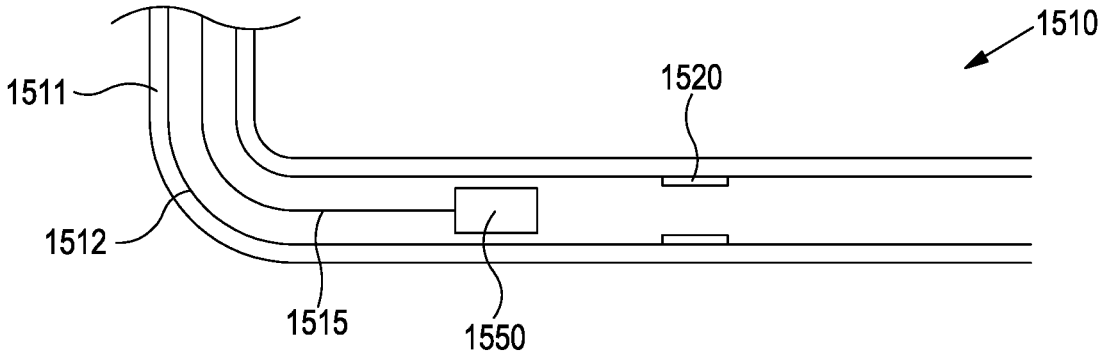
FIGS. 25A and 25B are simplified sectional diagrams through a production well showing the steps of installing a tracer release system in accordance with an aspect of the invention.

FIG. 25A shows a simplified section through part of a production well 1510. A central production tubing 1512 is arranged in the well surrounded by annulus 1511. A landing nipple 1520 is located in the production tubing at the time the wellbore is completed.

FIG. 25A shows the retrofitting installation of the tracer release apparatus 1550 into the without the need to remove the production tubing from the wellbore.

Figure 25B:
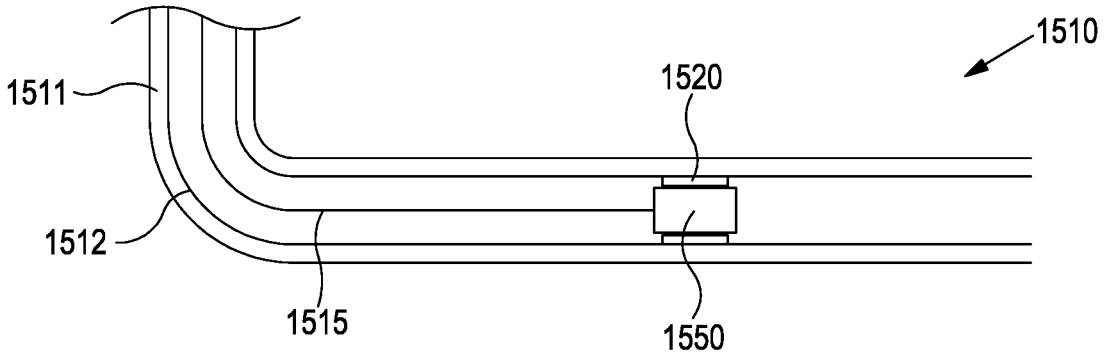

As shown in FIG. 25A the tracer release apparatus 1550 is conveyed through the production tubing from surface by wireline 1515. It will be appreciated that other conveyances methods may be used including slickline and coiled tubing. The tracer release apparatus 1550 is dimensioned such that it engages and connects to the landing nipple 1520 to install the tracer release apparatus 1550 as shown in FIG. 25B. The tracer release apparatus 1550 can be installed and/or replaced without having to retrieve the production tubing to the surface. For example the tracer release apparatus may be retrieved and/or replaced due to a component failure or requirements to change or replace the tracer material or the operating parameters of the tracer release apparatus.

Additionally or alternatively, a component of the tracer release apparatus 1550 can be retrieved, replaced or adjusted without having to retrieve the tracer release apparatus 1550 to the surface. For example a valve on the tracer release apparatus may be retrieved, replaced or adjusted due to valve failure or requirements to change the valve type, or the operating parameters of the valve.

It will be appreciated that depending on the operation and configuration of the tracer release apparatus 1550 the landing nipple may have ports in the side wall of the nipple. The ports may be in communication with the production tubing and/or the annulus and when the tracer release apparatus is installed on the nipple the tracer release apparatus 1550 may be in fluid communication with the production tubing and/or the annulus via the ports in the nipple.

The data collected at the detection point as described in the above examples may be analysed to identify the arrival of the concentration peaks of each tracer to determine the percent of inflow that occurs between tracer locations. The tracer locations may be known locations in the well geometry.

When the tracer is released from two or more tracer release apparatus to the surface their arrival at the surface is monitored and analysed to determine the inflow distribution. The volume between the arrival of each tracer peak is proportional to the inflow that occurs upstream of each tracer.

The tracer transients are driven by the velocity field in the well. The topside arrivals of the tracers can be used to estimate the downhole velocity field. From the velocity field the inflow profile may be calculated. The concentration of tracers at surface as a function of time is related to the influx into the well, by the velocity field. The tracer concentrations are governed by the velocity field. The velocity field is influenced by the well geometry and transport path of the fluid flow.

A model may be used based on the well geometry of the production well that assumes a specific scenario of inflow distribution, simulates the arrival time of the tracer peaks, and compares the simulated results to the actual peak arrivals. After several iterations, the model may converge on a solution that provides an inflow distribution that best fits the actual data. The model may include a model transport path corresponding to the actual well's transport path downstream of the influx zones.

The model should include an influx model corresponding to the real influx locations, a tracer system model and having even model leak or release rate corresponding to the real tracer sources and a model well transport path corresponding to the actual production well.

The tracer concentration may be calculated as a function of time. The measured tracer concentrations may be compared with modeled tracer concentrations to derive information about downhole inflow profiles.

Samples may be collected and/or measured downstream at known sampling times. Based on the measured concentrations and their sampling sequence and the well geometry the influx volumes may be calculated. The influx volumes may be calculated from transient flow models.

Model concentrations for each tracer material may be calculated in a modeled downstream well flow transport path as a function of time under a modeled transient occurring in the model.

Additionally or alternatively the data collected at the detection point as described in the above examples may be analysed to identify the rate of decline of the tracer concentration from each tracer location to determine the percent of reservoir inflow from each influx zone.

When the tracer is flushed out of the tracer release apparatus the zones with high inflow rates flush out the tracer faster than zones with low inflow rates, thereby preserving the high concentration of tracer molecules and generating a profile with steep rates of decline.

Conversely the concentration of tracer molecules in the fluid that is flushed out from a low-performing zone becomes more diluted as it enters the main flow stream and travels to the surface. Consequently, the profile of the tracer concentration presents a less steep rate of decline when compared to a high-performing zone. The data may be analysed to compare the rate of decline in tracer concentration between each monitored zone and quantitatively determines the respective relative inflow rates.

The collection, detection, analysis and/or interpretation of tracer data in production fluid may be considered as separate methods from one another and performed at different times or jurisdictions. The detection, analysis and/or interpretation of tracer in production fluid may be separate methods to release of tracer cloud from the tracer release apparatus and/or the collection of samples. Samples may be collected and the tracer detected, analysed and/or interpreted at a time or jurisdiction which is separate and distinct from the location of well and therefore the collection of the samples.

Although the above examples describe the control and actuation of the at least one valve by differential pressure or changes in flow velocity, additional or alternatively the at least one valve may be electrically controlled and actuated. The at least one electrical valve may be controlled remotely by wired and/or wireless communication.

The invention provides a tracer release system and method of use. The tracer release comprises at least one tracer chamber for connection to a production tubing. The at least one tracer chamber comprising at least one inlet, at least one outlet, a fluid volume and a tracer material located in the fluid volume. The tracer chamber also comprises a valve configured to selectively open and/or close the at least one outlet.

The tracer release system may be able to selectively shut-in each tracer release apparatus located at or near an influx zone. A high concentration of tracer is built up in the tracer release apparatus which is selectively flushed-out when the tracer release apparatus is opened. By analysing the arrival pattern of tracers on the surface and tracer concentration decay, it is possible to determine both qualitatively and quantitatively an influx profile of the well.

The tracer release system may be able to selectively release a high or increased concentration of tracer particles from each tracer release apparatus also known as a tracer cloud into the production flow to allow flow measurement and wellbore inflow profiles to be calculated and monitored.

A benefit of the tracer release system is that is capable of selectively generating increased or high concentrations of tracer particles in the tracer release apparatus and releasing the tracer particles from the tracer release apparatus without requiring the shutting in of the well.

Another benefit of the tracer release system is that is capable of releasing an increased or high concentration of tracer as a tracer cloud which can be detected in the production at surface, but it also controls the exposure of the tracer material in the tracer release apparatus to production fluid to extend the lifespan of the tracer downhole.

Throughout the specification, unless the context demands otherwise, the terms 'comprise' or 'include', or variations such as 'comprises' or 'comprising', 'includes' or 'including' will be understood to imply the inclusion of a stated integer or group of integers, but not the exclusion of any other integer or group of integers. Furthermore, relative terms such as", "downstream","upstream" and the like are used herein to indicate directions and locations as they apply to the appended drawings and will not be construed as limiting the invention and features thereof to particular arrangements or orientations. Likewise, the term "outlet" shall be construed as being an opening which, dependent on the direction of the movement of a fluid and may also serve as an "inlet", and vice versa.

The foregoing description of the invention has been presented for the purposes of illustration and description and is not intended to be exhaustive or to limit the invention to the precise form disclosed. The described embodiments were chosen and described in order to best explain the principles of the invention and its practical application to thereby enable others skilled in the art to best utilise the invention in various embodiments and with various modifications as are suited to the particular use contemplated. Therefore, further modifications or improvements may be incorporated without departing from the scope of the invention as defined by the appended claims.

Various modifications to the above-described embodiments may be made within the scope of the invention, and the invention extends to combinations of features other than those expressly claimed herein.

The invention claimed is:

1. A tracer release system for a producing petroleum well comprising:

at least one tracer release apparatus for connection to a production tubing, the at least one tracer release apparatus comprising:

at least one outlet;

at least one tracer chamber in fluid communication with the at least one outlet;

a tracer material located in the tracer chamber; and at least one valve configured to selectively control the flow of fluid through the at least one outlet;

wherein the at least one valve is configured to at least partially close the at least one outlet such that a concentration of tracer molecules in a fluid volume in the tracer chamber increases while the at least one outlet remains at least partially closed.

2. The tracer release system according to claim 1 wherein the at least one tracer release apparatus comprises at least one inlet in fluid communication with the at least one tracer chamber.

3. The tracer release system according to claim 2 wherein the at least one valve can be selectively moved between a fully closed position and a fully opened position to selectively control a flow of well fluid through the tracer chamber.

4. The tracer release system according to claim 1 wherein the at least one valve is configured to selectively open and close the at least one outlet between a fully open position, a fully closed position, or to an intermediate position between the fully open and fully closed position.

5. The tracer release system according to claim 1 wherein the tracer material is configured to release tracer molecules from the tracer material into a fluid in the tracer chamber on contact with a particular well fluid.

6. The tracer release system according to claim 1 wherein the tracer material is selected from the group comprising chemical, fluorescent, phosphorescent, magnetic, DNA and radioactive compounds.

7. The tracer release system according to claim 1 wherein the tracer material comprises a tracer and a carrier.

8. The tracer release system according to claim 1 wherein the at least one valve is an electrically operated valve, a differential pressure operated valve or a velocity valve.

9. The tracer release system according to claim 1 wherein the at least one valve is configured to shut in the at least one tracer release apparatus at a predetermined production flow rate and/or production fluid pressure.

10. The tracer release system according to claim 1 comprising at least one flow restriction device configured to control the release rate of the tracer molecules from the tracer chamber of the tracer release apparatus into the production tubing.

11. A method of releasing a tracer into a production flow comprising:

providing at least one tracer release apparatus connected to production tubing, the at least one tracer release apparatus comprising;

at least one outlet;

at least one tracer chamber in fluid communication with the at least one outlet;

a tracer material disposed in the tracer chamber;

at least one valve configured to selectively control the flow of fluid through the at least one outlet;

opening the at least one valve and releasing tracer molecules from the at least one tracer chamber through the at least one outlet; and closing the at least one valve to shut in the at least one tracer release apparatus such that a concentration of tracer molecules in a fluid volume in the tracer chamber increases while the at least one valve remains shut.

12. The method according to claim 11 comprising opening the at least one valve by modifying the production flow rate in the production tubing.

13. The method according to claim 11 comprising closing the at least one valve by modifying the production flow rate in the production tubing.

14. The method according to claim 11 comprising restricting flow though the tracer release apparatus to control and/or delay the release of fluid from the tracer release apparatus to the production tubing.

15. A method of estimating an influx profile for at least one of the well fluids to a producing well with two or more influx zones to a production flow comprising:

arranging two or more tracer release apparatuses connected to the production tubing at known levels of the well, wherein each tracer release apparatus comprises:

at least one outlet in fluid communication with the production flow;

at least one tracer chamber in fluid communication with the at least one outlet;

a distinct tracer material located in each tracer chamber; and at least one valve configured to selectively control the flow of fluid through the at least one outlet, wherein the at least one valve is configured to shut in the tracer release apparatus such that a concentration of tracer molecules in a fluid volume in the tracer chamber increases while the tracer release apparatus remains shut in;

opening the at least one valve of the two or more tracer release apparatuses to release tracer molecules from the tracer chambers of the two or more tracer release apparatuses into the production flow though the at least one outlet; and measuring the concentration of tracer and estimating an influx profile for at least one of the well fluids based on the type of tracer and the measured tracer concentrations.

16. The method according to claim 15 comprising analysing the arrival of concentration peaks of each tracer to determine the percent of inflow that occurs between tracer locations.

17. The method according to claim 15 comprising analysing a rate of decline of the tracer concentration from each tracer location and/or tracer release apparatus location to determine the percent of reservoir inflow from each influx zone.

18. The method according to claim 15 comprising analysing characteristics of the tracer release, sampling time, and/or cumulative produced volume of the influx volumes from different influx zones.

19. The method according to claim 15 comprising opening the at least one valve of the two or more tracer release apparatuses by adjusting the flow velocity and/or flow pressure in the production tubing.

20. The method according to claim 15 comprising closing the at least one valve of the two or more tracer release apparatuses to shut in the tracer release apparatuses by adjusting the flow velocity and/or flow pressure in the production tubing.

21. The method according to claim 15 comprising creating at least one detectable tracer spike at a detection point downstream of a tracer release apparatus.

22. The method according to claim 15 comprising opening the at least one valve on each of the two or more tracer release apparatuses at substantially the same time to release tracer molecules into the production flow.

23. The method according to claim 15 comprising controlling and/or delaying the release of fluid from at least one of the two or more tracer release apparatuses into the production tubing by restricting flow from the at least one tracer release apparatus to the production tubing.

24. The method according to claim 15 comprising measuring the tracer concentrations in real time or taking samples for further analysis onsite or offsite.

25. A method of monitoring influx of a fluid to a hydrocarbon producing well, the method comprising:

providing at least one tracer release apparatus connected to a production tubing in a hydrocarbon producing well at an influx location, the tracer release apparatus comprising:

a chamber having a fluid volume;

a tracer material located in the fluid volume;

an outlet to the chamber; and a controllable valve configured to selectively control the flow of fluid through the outlet;

modifying the production flow rate between a first production flow rate at which the controllable valve is closed to shut in the fluid volume such that a concentration of tracer molecules in the fluid volume increases and a second production flow rate at which the controllable valve is at least partially opened to allow fluid and the tracer material to flow from the fluid volume to the production tubing, thereby creating an increased concentration of tracer in the production tubing; and detecting the presence of tracer downstream of the influx location.

26. The method according to claim 25 comprising detecting the presence of tracer material at a downhole detection location, a surface detection location, or a detection location in a direction towards the surface of the production well.

27. The method according to claim 25 wherein the second production flow rate is higher than the first production flow rate and/or a third production flow rate.

28. The method according to claim 25 wherein the second production flow rate is lower than the first production flow rate and/or a third production flow rate.

29. The method according to claim 25 wherein the tracer release apparatus has an inlet wherein the method comprises actuating the controllable valve to open and or close the inlet and/or outlet to selectively control the flow of fluid through the outlet.

30. The method according to claim 25 comprising providing two or more tracer release apparatus connected to the production tubing in the hydrocarbon producing well, each tracer release apparatus at a different influx location.

* * * * *